US012121200B2

(12) United States Patent
Khazaieli et al.

(10) Patent No.: US 12,121,200 B2
(45) Date of Patent: Oct. 22, 2024

(54) VACUUM-BASED METHOD AND APPARATUS FOR CLEANING SOILED ARTICLES

(71) Applicant: FATTHOME, INC., Pacific Palisades, CA (US)

(72) Inventors: Amir Khazaieli, Long Beach, CA (US); Aaron Rowe, Toluca Lake, CA (US)

(73) Assignee: FATHHOME, INC., Pacific Palisades, CA (US)

( * ) Notice: Subject to any disclaimer, the term of this patent is extended or adjusted under 35 U.S.C. 154(b) by 0 days.

(21) Appl. No.: 18/161,786

(22) Filed: Jan. 30, 2023

(65) Prior Publication Data

US 2023/0240489 A1 Aug. 3, 2023

Related U.S. Application Data

(63) Continuation of application No. 17/020,758, filed on Sep. 14, 2020, now Pat. No. 11,564,540, which is a (Continued)

(51) Int. Cl.
*A47L 5/38* (2006.01)
*A47L 5/22* (2006.01)

(Continued)

(52) U.S. Cl.
CPC ..... *A47L 5/38* (2013.01); *A47L 5/22* (2013.01); *D06F 58/203* (2013.01); *D06F 19/00* (2013.01);

(Continued)

(58) Field of Classification Search
CPC . A47L 5/38; A47L 5/22; D06F 58/203; D06F 2103/00; D06F 2105/58;

(Continued)

(56) References Cited

U.S. PATENT DOCUMENTS 3,605,278 A * 9/1971 Ramsay ..... F26B 5/04 34/92
6,231,647 B1 * 5/2001 Cheng ..... A47L 5/24 96/108

(Continued)

FOREIGN PATENT DOCUMENTS

WO WO-2017184769 A1 * 10/2017 ..... A47L 5/22

*Primary Examiner* — Stephen M Gravini
(74) *Attorney, Agent, or Firm* — Miller IP Law; Devin Miller

(57) ABSTRACT

Disclosed herein, in certain embodiments, are vacuum-based systems, products, devices, and methods for de-odorizing, disinfecting, or cleaning articles such as clothing, shoes, toys, or dishes. A system or device can comprise a vacuum chamber comprising a housing defining an internal space having an internal pressure and an opening; a vacuum lid adapted to engage with the opening of the vacuum chamber; and a vacuum source connected to the vacuum chamber, wherein operation of the vacuum source reduces the internal pressure of the internal space of the vacuum chamber, wherein the lower internal pressure enhances the vaporization and removal of odors located on one or more articles disposed within the vacuum chamber.

17 Claims, 13 Drawing Sheets

Related U.S. Application Data continuation of application No. 16/095,307, filed as application No. PCT/US2017/028422 on Apr. 19, 2017, now Pat. No. 10,772,477.

(60) Provisional application No. 62/325,388, filed on Apr. 20, 2016.

(51) Int. Cl.

| | |
|---|---|
| ***D06F 19/00*** | (2006.01) |
| ***D06F 34/28*** | (2020.01) |
| ***D06F 43/00*** | (2006.01) |
| ***D06F 43/08*** | (2006.01) |
| ***D06F 58/20*** | (2006.01) |
| ***D06F 101/20*** | (2020.01) |
| ***D06F 103/00*** | (2020.01) |
| ***D06F 105/58*** | (2020.01) |

(52) U.S. Cl.

CPC ..... *D06F 34/28* (2020.02); *D06F 43/00* (2013.01); *D06F 43/08* (2013.01); *D06F 2101/20* (2020.02); *D06F 2103/00* (2020.02); *D06F 2105/58* (2020.02)

(58) Field of Classification Search

CPC ..... D06F 2101/20; D06F 34/28; D06F 19/00; D06F 43/00; D06F 43/08; D06F 35/00

USPC ..... 34/596

See application file for complete search history.

(56) References Cited

U.S. PATENT DOCUMENTS

| | | | | |
|---|---|---|---|---|
| 7,182,820 | B2 * | 2/2007 | Campbell | H04R 25/00 134/1 |
| 9,669,124 | B2 * | 6/2017 | Leyva | A61L 2/202 |
| 9,709,327 | B2 * | 7/2017 | Marchiori | F26B 25/16 |
| 9,907,872 | B2 * | 3/2018 | Schmidt | A61L 2/0094 |
| 10,485,888 | B2 * | 11/2019 | Schmidt | A61L 2/10 |
| D889,681 | S * | 7/2020 | Maw | D24/217 |
| 11,564,540 | B2 * | 1/2023 | Khazaieli | A47L 5/22 |
| 2011/0130877 | A1 * | 6/2011 | Lynch | A61L 9/14 239/34 |

* cited by examiner

VACUUM-BASED METHOD AND APPARATUS FOR CLEANING SOILED ARTICLES

CROSS-REFERENCE TO RELATED APPLICATIONS

The present application is a continuation of U.S. patent application Ser. No. 17/020,758, filed Sep. 14, 2020 which is a continuation of U.S. patent application Ser. No. 16/095,307, filed Oct. 19, 2018 which is a U.S. National Phase of International Application No. PCT/US17/28422, filed Apr. 19, 2017, which claims the benefit of U.S. Provisional Application No. 62/325,388, filed Apr. 20, 2016. The entire contents of the above-listed application are hereby incorporated by reference for all purposes.

BACKGROUND

Clothing, linen, and other articles become soiled over time from a variety of sources. Existing water-based laundry machines agitate the laundry articles inside a container of water with dissolved surfactants that bind and remove dirt, odors, and stains. Alternatively, dry cleaning utilizes the same process but replaces water with a non-aqueous liquid solvent such as tetrachloroethylene ("PERC") which has toxic and carcinogenic properties. Both water-based and non-water-based laundry machines utilize outdated cleaning processes over a century old. They are energy-intensive and produce significant amounts of waste (e.g. wastewater, PERC). Furthermore, there is a lack of automated systems, devices, or methods for cleaning certain articles such as shoes, leather, and highly fragile garments, which are typically hand-cleaned and/or cleaned infrequently.

SUMMARY

The "dirt" in dirty laundry is made up of a variety of unwelcome substances such as unpleasant personal odors (e.g. body odor), external odors (e.g. cigarette smoke), germs (e.g. odorant producing bacteria, pathogenic bacteria, etc.), and stains. Current cleaning technologies do not discriminate between the various types of "dirt" found on laundry and other articles that need cleaning. All laundry, ranging from the slightly worn shirt to grass-stained soccer shorts, get dumped together into washers & dryers that operate on incremental improvements to the same old technology. Current washer & dryer technology do not offer specificity in the degree of cleaning provided to address the different kinds of "dirt" that need to be removed. Specifically, they do not offer an individualized cleaning process that is capable of focusing only on odor removal, disinfection, stain removal, or a combination thereof. Given mounting environmental concerns relating to waste disposal, water usage, and energy usage, provided herein are systems, methods, and devices that remove odors, dirt, stains, and/or disinfect in a water-less or reduced water, energy-efficient process with safe or minimal discharge of hazardous or non-hazardous waste.

Disclosed herein, in certain embodiments, are vacuum-based devices configured to remove odors comprising: a vacuum-based odor-removing device comprising: a vacuum chamber comprising: a housing defining an internal space having an internal pressure; an opening; a vacuum lid adapted to engage with the opening of the vacuum chamber; and a vacuum source connected to the vacuum chamber, wherein operation of the vacuum source reduces the internal pressure of the internal space of the vacuum chamber. In some embodiments, the vacuum source is a vacuum pump engaged with the vacuum chamber, wherein the vacuum pump is configured to remove gases from inside the vacuum chamber to lower the internal pressure. In some embodiments, the device is configured to de-odorize at least one article disposed within the vacuum chamber, wherein said article is selected from the group consisting of clothing, linen, footwear, cushions, pillows, bags, purses, toys, containers, food, and foodstuffs. In some embodiments, the device is configured to remove personal odors from at least one article disposed within the vacuum chamber. In some embodiments, the device is configured to de-odorize footwear. In some embodiments, the device is configured to vaporize and remove odor molecules having a molecular weight below 330 g/mol, below 300 g/mol, below 250 g/mol, below 200 g/mol, below 150 g/mol, below 100 g/mol, below 50 g/mol, or below 30 g/mol. In some embodiments, the vacuum lid is adapted to engage with the opening of the vacuum chamber by means of a gasket, wherein the gasket is resistant to at least one of heat, ozone, weather, polar substances, aging, alkalis, acids, wear-and-tear, oxygenated solvents, and steam. In some embodiments, the device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min, 100 Torr/min, 150 Torr/min, 200 Torr/min, 250 Torr/min, 300 Torr/min, 350 Torr/min, 400 Torr/min, 450 Torr/min. 500 Torr/min. 550 Torr/min, 600 Torr/min, 650 Torr/min. 700 Torr/min, 750 Torr/min, 760 Torr/min. 800 Torr/min, 900 Torr/min, Torr/min, Torr/min, Torr/min, Torr/min, Torr/min, Torr/min, Torr/min, Torr/min, Torr/min, Torr/min, or Torr/min. In some embodiments, the device further comprises a consumables subsystem configured to introduce at least one consumable into the chamber before, during, or after a vacuum cycle. In some embodiments, the device further comprises at least one spray nozzle engaged with the consumables subsystem, wherein the spray nozzle is configured to disperse the at least one consumable into the vacuum chamber. In some embodiments, the device further comprises a subsystem configured to introduce at least one gas into the vacuum chamber, wherein said gas is configured to carry out at least one of the following functions: neutralizing odor, binding odor, dissolving odor, removing odor, and masking odor (e.g. by adding fragrance). In some embodiments, the gas is stored inside a cartridge configured to engage with the subsystem. In some embodiments, the gas is stored as a compressed liquid. In some embodiments, the vacuum chamber is configured to maintain a pressure seal when the subsystem injects one or more gases into the vacuum chamber, wherein the resulting internal pressure of the vacuum chamber is higher than external ambient pressure. In some embodiments, the device further comprises a control system having a processor and a user interface, wherein the control system is configured to accept instructions and operate the device based on said instructions. In some embodiments, the device further comprises at least one sensor disposed within the vacuum chamber, said sensor configured to function at sub-atmospheric pressure levels, wherein said at least one sensor is configured to measure at least one property selected from the group consisting of pressure, volatile organic compounds, relative humidity, dew-point, small particles, and temperature. In some embodiments, the device is configured to run for at least one cleaning cycle, wherein a cleaning cycle is selected from an asymptotic cycle, a storage cycle, and a margin cycle. In some embodiments, the control system comprises a software module for controlling the device, wherein the software module provides a cleaning objective, said cleaning objective being a preset objective, an algorithmically calculated objective, or a user entered objective. In some embodiments, the cleaning cycle objective is reducing the partial pressure of odor particles in the vacuum chamber by a target percentage from an initial partial pressure, wherein the initial partial pressure is measured before the start of the cleaning cycle. In some embodiments, the device further comprises a heating subsystem configured to heat the vacuum chamber. In some embodiments, the control system operates the heating subsystem to enhance the vaporization of odor molecules from an article disposed within the vacuum chamber without damaging the article, wherein the internal temperature is no greater than 100 degrees Celsius, no greater than 90 degrees Celsius, no greater than 80 degrees Celsius, no greater than 70 degrees Celsius, no greater than 60 degrees Celsius, no greater than 50 degrees Celsius, no greater than 40 degrees Celsius, or no greater than 30 degrees Celsius. In some embodiments, the control system provides an interface for receiving user input to set the target temperature for the heating subsystem. In some embodiments, the device further comprises a mechanism for agitating the contents of the vacuum chamber. In some embodiments, the mechanism for agitation comprises a fan. In some embodiments, the vacuum chamber is configured to maintain a pressure seal with the vacuum lid when the internal pressure is lower than external pressure. In some embodiments, the vacuum chamber is configured to maintain a pressure seal with the vacuum lid when the internal pressure is higher than external pressure. In some embodiments, the device further comprises a latching mechanism, wherein the latching mechanism is configured to keep the vacuum lid engaged with the vacuum chamber before the internal pressure of the vacuum chamber is reduced, wherein the vacuum pressure generated by the negative internal pressure of the vacuum chamber maintains the pressure seal with the vacuum lid during a cleaning cycle. In some embodiments, the device further comprises a filtering mechanism for removing at least one of odors and particulates from the gases pumped out of the vacuum chamber. In some embodiments, the filtering mechanism comprises at least one of a HEPA filter and activated carbon filter. In some embodiments, the vacuum chamber comprises an internal coating configured to resist microbial growth. In some embodiments, the internal coating comprises copper or a copper alloy, wherein the copper and its alloy have antimicrobial properties. In some embodiments, the internal coating comprises at least one material selected from organosilanes, titanium dioxide, quaternary ammonium compounds, bactericides (e.g. chlorhexidine), viral inhibitors, and fungal inhibitors. In some embodiments, the device comprises a heat sink. In some embodiments, the heat sink comprises a passageway for receiving flow of a consumable. In some embodiments, the consumable is aerosolized while passing through the passageway of the heat sink. In some embodiments, the control system receives automatic updates. In some embodiments, an automatic update comprises a new cleaning cycle algorithm. In some embodiments, the device comprises at least one ultrasonic transducer for providing ultrasonic agitation of one or more articles inside the vacuum chamber.

Disclosed herein, in certain embodiments, are vacuum-based devices configured to disinfect comprising a vacuum chamber comprising: a housing defining an internal space having an internal pressure and an opening; a vacuum lid adapted to engage with the opening; a vacuum source engaged with the vacuum chamber, wherein the vacuum source is configured to remove gases from the internal space of the vacuum chamber; and a subsystem configured to release at least one disinfecting compound into the vacuum chamber. In some embodiments, the vacuum source is a vacuum pump engaged with the vacuum chamber, wherein the vacuum pump is configured to remove gases from inside the vacuum chamber to lower the internal pressure. In some embodiments, the device is configured to disinfect at least one article disposed within the vacuum chamber, wherein said article is selected from the group consisting of clothing, linen, footwear, cushions, pillows, bags, purses, toys, and containers. In some embodiments, the device is configured to disinfect footwear. In some embodiments, the device is configured to disinfect toys. In some embodiments, the disinfecting compound is stored as a compressed liquid, wherein the disinfecting compound is a gas at room temperature and 1 atmospheric pressure. In some embodiments, the disinfecting compound is stored within a detachable cartridge configured to engage with a bracket, slot, or chamber of the subsystem. In some embodiments, the subsystem comprises a reservoir for storing at least one disinfecting compound. In some embodiments, the disinfecting compound is a liquid at room temperature and 1 atmospheric pressure having a latent heat of evaporation. In some embodiments, the liquid disinfecting compound has a latent heat of evaporation of less than kJ/kg, less than 900 kJ/kg, less than 800 kJ/kg, less than 700 kJ/kg, less than 600 kJ/kg, less than 500 kJ/kg, less than 400 kJ/kg, less than 300 kJ/kg, less than 200 kJ/kg, less than 100 kJ/kg, less than 90 kJ/kg, less than 80 kJ/kg, less than 70 kJ/kg, less than 60 kJ/kg, less than 50 kJ/kg, less than 40 kJ/kg, less than 30 kJ/kg, less than 20 kJ/kg, or less than 10 kJ/kg. In some embodiments, the disinfecting compound has a molecular weight below 330 g/mol, below 300 g/mol, below 250 g/mol, below 200 g/mol, below 150 g/mol, below 100 g/mol, below 50 g/mol, or below 30 g/mol. In some embodiments, the disinfecting compound is selected from at least one of carbon dioxide, oxygen, ozone, chlorine dioxide, hydrogen peroxide, propylene glycol, triethylene glycol, and alcohol (e.g. ethanol, isopropanol, etc). In some embodiments, the device is configured to run for at least one disinfecting cycle, wherein a disinfecting cycle comprises: introducing one or more disinfectant compound into the vacuum chamber; incubating for a period of time suitable for disinfection of an article disposed within the vacuum chamber; and activating the vacuum pump to vaporize and remove the disinfectant compound from the vacuum chamber. In some embodiments, the vacuum lid is adapted to engage with the opening of the vacuum chamber by means of a gasket, wherein the gasket is resistant to at least one of heat, ozone, weather, polar substances, aging, alkalis, acids, wear-and-tear, oxygenated solvents, and steam. In some embodiments, the device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min, 100 Torr/min, 150 Torr/min, 200 Torr/min, 250 Torr/min, 300 Torr/min, 350 Torr/min, 400 Torr/min, 450 Torr/min, 500 Torr/min, 550 Torr/min, 600 Torr/min. 650 Torr/min, 700 Torr/min, 750 Torr/min, 760 Torr/min, 800 Torr/min, 900 Torr/min, Torr/min, Torr/min, Torr/min, Torr/min, Torr/min, Torr/min, Torr/min, Torr/min, Torr/min, Torr/min, or Torr/min. In some embodiments, the device further comprises a consumables subsystem configured to introduce at least one consumable into the chamber before, during, or after a vacuum cycle. In some embodiments, the device further comprises a subsystem configured to introduce at least one gas into the vacuum chamber, wherein said gas is configured to carry out at least one of the following anti-odor functions: neutralizing odor, binding odor, dissolving odor, removing odor, and masking odor (e.g. by adding fragrance). In some embodiments, the gas is stored inside a cartridge configured to engage with the subsystem. In some embodiments, the gas is stored as a compressed liquid. In some embodiments, the vacuum chamber is configured to maintain a pressure seal when the subsystem injects one or more gases into the vacuum chamber, wherein the resulting internal pressure of the vacuum chamber is higher than external ambient pressure. In some embodiments, the device further comprises a single subsystem configured to receive one or more cartridges containing a gas with anti-odor functions, a disinfecting compound, or a consumable. In some embodiments, the vacuum chamber further comprises at least one spray nozzle engaged with the subsystem, wherein the spray nozzle is configured to disperse at least one of an anti-odor gas, a disinfecting compound, and a consumable into the vacuum chamber. In some embodiments, the device further comprises a control system having a processor and a user interface, wherein the control system is configured to accept instructions and operate the device based on said instructions. In some embodiments, the device further comprises at least one sensor disposed within the vacuum chamber, said sensor configured to function at sub-atmospheric pressure levels, wherein said at least one sensor is configured to measure at least one property selected from the group consisting of pressure, volatile organic compounds, relative humidity, dew-point, small particles, and temperature. In some embodiments, the device is configured to run for at least one cleaning cycle, wherein a cleaning cycle is selected from an asymptotic cycle, a storage cycle, and a margin cycle. In some embodiments, the control system comprises a software module for controlling the device, wherein the software module provides a cleaning objective, said cleaning objective being a preset objective, an algorithmically calculated objective, or a user entered objective. In some embodiments, the cleaning cycle objective is reducing the partial pressure of odor particles in the vacuum chamber by a target percentage from an initial partial pressure, wherein the initial partial pressure is measured before the start of the cleaning cycle. In some embodiments, the device further comprises a heating subsystem configured to heat the vacuum chamber. In some embodiments, the control system operates the heating subsystem to enhance the vaporization of odor molecules from an article disposed within the vacuum chamber without damaging the article, wherein the internal temperature is no greater than 100 degrees Celsius, no greater than 90 degrees Celsius, no greater than 80 degrees Celsius, no greater than 70 degrees Celsius, no greater than 60 degrees Celsius, no greater than 50 degrees Celsius, no greater than 40 degrees Celsius, or no greater than 30 degrees Celsius. In some embodiments, the control system provides an interface for receiving user input to set the target temperature for the heating subsystem. In some embodiments, the device further comprises a mechanism for agitating the contents of the vacuum chamber. In some embodiments, the mechanism for agitation comprises a fan. In some embodiments, the vacuum chamber is configured to maintain a pressure seal with the vacuum lid when the internal pressure is lower than external pressure. In some embodiments, the vacuum chamber is configured to maintain a pressure seal with the vacuum lid when the internal pressure is higher than external pressure. In some embodiments, the device further comprises a latching mechanism, wherein the latching mechanism is configured to keep the vacuum lid engaged with the vacuum chamber before the internal pressure of the vacuum chamber is reduced, wherein the vacuum pressure generated by the negative internal pressure of the vacuum chamber maintains the pressure seal with the vacuum lid during a cleaning cycle. In some embodiments, the device further comprises an air filter for filtering the gases pumped out of the vacuum chamber by the vacuum source, said filter configured to collect at least one of airborne particles, odors, and the disinfectant compound. In some embodiments, the air filter is a chemical air filter, a UV light air filter, an ionic air filter, or a particulate air filter. In some embodiments, the device further comprises a UV source configured to inactivate microbes located on an article disposed within the vacuum chamber. In some embodiments, the vacuum chamber comprises an internal coating configured to resist microbial growth. In some embodiments, the internal coating comprises copper or a copper alloy, wherein the copper and its alloy have antimicrobial properties. In some embodiments, the internal coating comprises at least one material selected from organosilanes, titanium dioxide, quaternary ammonium compounds, bactericides (e.g. chlorhexidine), viral inhibitors, and fungal inhibitors. In some embodiments, the device comprises a heat sink. In some embodiments, the heat sink comprises a passageway for receiving flow of a consumable. In some embodiments, the consumable is aerosolized while passing through the passageway of the heat sink. In some embodiments, the control system receives automatic updates. In some embodiments, an automatic update comprises a new cleaning cycle algorithm. In some embodiments, the device comprises at least one ultrasonic transducer for providing ultrasonic agitation of one or more articles inside the vacuum chamber.

Disclosed herein, in certain embodiments, are vacuum-based cleaning devices comprising: a vacuum chamber comprising: a housing defining an internal space having an internal pressure and an opening; a vacuum lid adapted to engage with the opening; a vacuum source engaged with the vacuum chamber, wherein the pump is configured to remove gases from the internal space of the vacuum chamber; and a subsystem configured to release at least one cleaning compound into the internal space of the vacuum chamber. In some embodiments, the vacuum source is a vacuum pump engaged with the vacuum chamber, wherein the vacuum pump is configured to remove gases from inside the vacuum chamber to lower the internal pressure. In some embodiments, the device is configured to clean at least one article disposed within the vacuum chamber, wherein said article is selected from the group consisting of clothing, linen, footwear, cushions, pillows, bags, purses, toys, and containers. In some embodiments, the device is configured to clean clothing. In some embodiments, the device is configured to clean toys. In some embodiments, the device is configured for removing stains from at least one article disposed within the vacuum chamber In some embodiments, the cleaning compound is stored as a compressed liquid, wherein the cleaning compound is a gas at room temperature and 1 atmospheric pressure. In some embodiments, the cleaning compound is stored within a detachable cartridge configured to engage with a bracket, slot, or chamber of the subsystem. In some embodiments, the subsystem comprises a reservoir for storing at least one cleaning compound. In some embodiments, the cleaning compound is a liquid having a latent heat of evaporation. In some embodiments, the liquid cleaning compound has a latent heat of evaporation of less than kJ/kg, less than 900 kJ/kg, less than 800 kJ/kg, less than 700 kJ/kg, less than 600 kJ/kg, less than 500 kJ/kg, less than 400 kJ/kg, less than 300 kJ/kg, less than 200 kJ/kg, less than 100 kJ/kg, less than 90 kJ/kg, less than 80 kJ/kg, less than 70 kJ/kg, less than 60 kJ/kg, less than 50 kJ/kg, less than 40 kJ/kg, less than 30 kJ/kg, less than 20 kJ/kg, or less than 10 kJ/kg. In some embodiments, the cleaning compound has a molecular weight below 330 g/mol, below 300 g/mol, below 250 g/mol, below 200 g/mol, below 150 g/mol, below 100 g/mol, below 50 g/mol, or below 30 g/mol. In some embodiments, the cleaning compound is selected from at least one of a detergent, a solvent, and PERC. In some embodiments, the device is configured to run for at least one cleaning cycle, wherein a cleaning cycle comprises: introducing at least one cleaning compound into the vacuum chamber, wherein the vacuum chamber vacuum lid is engaged with the opening to form a pressure seal prior to initiation of the cleaning cycle; incubating for a period of time; activating the vacuum pump to remove the at least one cleaning compound from the vacuum chamber. In some embodiments, the vacuum lid is adapted to engage with the opening of the vacuum chamber by means of a gasket, wherein the gasket is resistant to at least one of heat, ozone, weather, polar substances, aging, alkalis, acids, wear-and-tear, oxygenated solvents, and steam. In some embodiments, the device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min, 100 Torr/min, 150 Torr/min, 200 Torr/min, 250 Torr/min, 300 Torr/min, 350 Torr/min, 400 Torr/min, 450 Torr/min, 500 Torr/min, 550 Torr/min, 600 Torr/min, 650 Torr/min, 700 Torr/min, 750 Torr/min. 760 Torr/min, 800 Torr/min, 900 Torr/min, Torr/min, Torr/min, Torr/min, Torr/min, Torr/min, Torr/min, Torr/min, Torr/min, Torr/min, Torr/min, or Torr/min. In some embodiments, the device further comprises a consumables subsystem configured to introduce at least one consumable into the chamber before, during, or after a vacuum cycle. In some embodiments, the device further comprises a subsystem configured to introduce at least one gas into the vacuum chamber, wherein said gas is configured to carry out at least one of the following anti-odor functions: neutralizing odor, binding odor, dissolving odor, removing odor, and masking odor (e.g. by adding fragrance). In some embodiments, the gas is stored inside a cartridge configured to engage with the subsystem. In some embodiments, the gas is stored as a compressed liquid. In some embodiments, the vacuum chamber is configured to maintain a pressure seal when the subsystem injects one or more gases into the vacuum chamber, wherein the resulting internal pressure of the vacuum chamber is higher than external ambient pressure. In some embodiments, the device further comprises a single subsystem configured to receive one or more cartridges containing a gas with anti-odor functions, a disinfecting compound, or a consumable. In some embodiments, the vacuum chamber further comprises at least one spray nozzle engaged with the subsystem, wherein the spray nozzle is configured to disperse at least one of an anti-odor gas, a disinfecting compound, and a consumable into the vacuum chamber. In some embodiments, the device further comprises a control system having a processor and a user interface, wherein the control system is configured to accept instructions and operate the device based on said instructions. In some embodiments, the device further comprises at least one sensor disposed within the vacuum chamber, said sensor configured to function at sub-atmospheric pressure levels, wherein said at least one sensor is configured to measure at least one property selected from the group consisting of pressure, volatile organic compounds, relative humidity, dew-point, small particles, and temperature. In some embodiments, the device is configured to run for at least one cleaning cycle, wherein a cleaning cycle is selected from an asymptotic cycle, a storage cycle, and a margin cycle. In some embodiments, the control system comprises a software module for controlling the device, wherein the software module provides a cleaning objective, said cleaning objective being a preset objective, an algorithmically calculated objective, or a user entered objective. In some embodiments, the cleaning cycle objective is reducing the partial pressure of the cleaning compound in the vacuum chamber by a target percentage from an initial partial pressure, wherein the initial partial pressure is measured near the start of the cleaning cycle. In some embodiments, the device further comprises a heating subsystem configured to heat the vacuum chamber. In some embodiments, the control system operates the heating subsystem to enhance the vaporization of the cleaning compound inside the vacuum chamber without damaging any articles, wherein the internal temperature is no greater than 100 degrees Celsius, no greater than 90 degrees Celsius, no greater than 80 degrees Celsius, no greater than 70 degrees Celsius, no greater than 60 degrees Celsius, no greater than 50 degrees Celsius, no greater than 40 degrees Celsius, or no greater than 30 degrees Celsius, in some embodiments, the control system provides an interface for receiving user input to set the target temperature for the heating subsystem. In some embodiments, the device further comprises a mechanism for agitating the contents of the vacuum chamber. In some embodiments, the mechanism for agitation comprises a fan. In some embodiments, the vacuum chamber is configured to maintain a pressure seal with the vacuum lid when the internal pressure is lower than external pressure. In some embodiments, the vacuum chamber is configured to maintain a pressure seal with the vacuum lid when the internal pressure is higher than external pressure. In some embodiments, the device further comprises a latching mechanism, wherein the latching mechanism is configured to keep the vacuum lid engaged with the vacuum chamber before the internal pressure of the vacuum chamber is reduced, wherein the vacuum pressure generated by the negative internal pressure of the vacuum chamber maintains the pressure seal with the vacuum lid during a cleaning cycle. In some embodiments, the device further comprises an air filter for filtering the gases pumped out of the vacuum chamber by the vacuum source, said filter configured to collect at least one of airborne particles, odors, and the cleaning compound. In some embodiments, the air filter is a chemical air filter, a UV light air filter, an ionic air filter, or a particulate air filter. In some embodiments, the device further comprises a UV source configured to inactivate microbes located on an article disposed within the vacuum chamber. In some embodiments, the vacuum chamber comprises an internal coating configured to resist microbial growth. In some embodiments, the internal coating comprises copper or a copper alloy, wherein the copper and its alloy have antimicrobial properties. In some embodiments, the internal coating comprises at least one material selected from organosilanes, titanium dioxide, quaternary ammonium compounds, bactericides (e.g. chlorhexidine), viral inhibitors, and fungal inhibitors. In some embodiments, the device comprises a heat sink. In some embodiments, the heat sink comprises a passageway for receiving flow of a consumable. In some embodiments, the consumable is aerosolized while passing through the passageway of the heat sink. In some embodiments, the control system receives automatic updates. In some embodiments, an automatic update comprises a new cleaning cycle algorithm. In some embodiments, the device comprises at least one ultrasonic transducer for providing ultrasonic agitation of one or more articles inside the vacuum chamber.

In another aspect, disclosed herein are vacuum-based odor-removing methods comprising: a) providing a vacuum-based cleaning device comprising: i) a vacuum chamber comprising a housing defining an internal space having an internal pressure; an opening; and a pressure release valve; ii) a vacuum lid adapted to engage with the opening of the vacuum chamber; iii) a vacuum pump connected to the vacuum chamber, said pump configured to remove gases from the internal space of the vacuum chamber; b) providing an article to be cleaned, wherein said article is placed within the internal space of the chamber; c) closing the vacuum lid, wherein the vacuum lid engages with the opening of the vacuum chamber to maintain an airtight seal; and d) turning on the vacuum pump, wherein operation of the vacuum pump reduces the internal pressure of the internal space of the vacuum chamber to sub-atmospheric levels; wherein the vacuum-based cleaning device removes odor molecules from the article by means of a partial vacuum generated by the reduction in internal pressure. In some embodiments, the vacuum source is a vacuum pump engaged with the vacuum chamber, wherein the vacuum pump is configured to remove gases from inside the vacuum chamber to lower the internal pressure. In some embodiments, the device is configured to de-odorize at least one article disposed within the vacuum chamber, wherein said article is selected from the group consisting of clothing, linen, footwear, cushions, pillows, bags, purses, toys, containers, food, and foodstuffs. In some embodiments, the device is configured to remove personal odors from at least one article disposed within the vacuum chamber. In some embodiments, the device is configured to de-odorize footwear. In some embodiments, the device is configured to vaporize and remove odor molecules having a molecular weight below 330 g/mol, below 300 g/mol, below 250 g/mol, below 200 g/mol, below 150 g/mol, below 100 g/mol, below 50 g/mol, or below 30 g/mol. In some embodiments, the vacuum lid is adapted to engage with the opening of the vacuum chamber by means of a gasket, wherein the gasket is resistant to at least one of heat, ozone, weather, polar substances, aging, alkalis, acids, wear-and-tear, oxygenated solvents, and steam. In some embodiments, the device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min, 100 Torr/min, 150 Torr/min, 200 Torr/min, 250 Torr/min, 300 Torr/min, 350 Torr/min. 400 Torr/min, 450 Torr/min, 500 Torr/min, 550 Torr/min. 600 Torr/min, 650 Torr/min, 700 Torr/min, 750 Torr/min, 760 Torr/min, 800 Torr/min, 900 Torr/min, Torr/min, Torr/min, Torr/min, Torr/min, Torr/min, Torr/min, Torr/min, Torr/min, Torr/min, Torr/min, or Torr/min. In some embodiments, the device further comprises a consumables subsystem configured to introduce at least one consumable into the chamber before, during, or after a vacuum cycle. In some embodiments, the device further comprises at least one spray nozzle engaged with the consumables subsystem, wherein the spray nozzle is configured to disperse the at least one consumable into the vacuum chamber. In some embodiments, the device further comprises a subsystem configured to introduce at least one gas into the vacuum chamber, wherein said gas is configured to carry out at least one of the following functions: neutralizing odor, binding odor, dissolving odor, removing odor, and masking odor (e.g. by adding fragrance). In some embodiments, the gas is stored inside a cartridge configured to engage with the subsystem. In some embodiments, the gas is stored as a compressed liquid. In some embodiments, the vacuum chamber is configured to maintain a pressure seal when the subsystem injects one or more gases into the vacuum chamber, wherein the resulting internal pressure of the vacuum chamber is higher than external ambient pressure. In some embodiments, the device further comprises a control system having a processor and a user interface, wherein the control system is configured to accept instructions and operate the device based on said instructions. In some embodiments, the device further comprises at least one sensor disposed within the vacuum chamber, said sensor configured to function at sub-atmospheric pressure levels, wherein said at least one sensor is configured to measure at least one property selected from the group consisting of pressure, volatile organic compounds, relative humidity, dew-point, small particles, and temperature. In some embodiments, the device is configured to run for at least one cleaning cycle, wherein a cleaning cycle is selected from an asymptotic cycle, a storage cycle, and a margin cycle. In some embodiments, the control system comprises a software module for controlling the device, wherein the software module provides a cleaning objective, said cleaning objective being a preset objective, an algorithmically calculated objective, or a user entered objective. In some embodiments, the cleaning cycle objective is reducing the partial pressure of odor particles in the vacuum chamber by a target percentage from an initial partial pressure, wherein the initial partial pressure is measured before the start of the cleaning cycle. In some embodiments, the device further comprises a heating subsystem configured to heat the vacuum chamber. In some embodiments, the control system operates the heating subsystem to enhance the vaporization of odor molecules from an article disposed within the vacuum chamber without damaging the article, wherein the internal temperature is no greater than 100 degrees Celsius, no greater than 90 degrees Celsius, no greater than 80 degrees Celsius, no greater than 70 degrees Celsius, no greater than 60 degrees Celsius, no greater than 50 degrees Celsius, no greater than 40 degrees Celsius, or no greater than 30 degrees Celsius. In some embodiments, the control system provides an interface for receiving user input to set the target temperature for the heating subsystem. In some embodiments, the device further comprises a mechanism for agitating the contents of the vacuum chamber. In some embodiments, the mechanism for agitation comprises a fan. In some embodiments, the vacuum chamber is configured to maintain a pressure seal with the vacuum lid when the internal pressure is lower than external pressure. In some embodiments, the vacuum chamber is configured to maintain a pressure seal with the vacuum lid when the internal pressure is higher than external pressure. In some embodiments, the device further comprises a latching mechanism, wherein the latching mechanism is configured to keep the vacuum lid engaged with the vacuum chamber before the internal pressure of the vacuum chamber is reduced, wherein the vacuum pressure generated by the negative internal pressure of the vacuum chamber maintains the pressure seal with the vacuum lid during a cleaning cycle. In some embodiments, the device further comprises a filtering mechanism for removing at least one of odors and particulates from the gases pumped out of the vacuum chamber. In some embodiments, the filtering mechanism comprises at least one of a HEPA filter and activated carbon filter. In some embodiments, the vacuum chamber comprises an internal coating configured to resist microbial growth. In some embodiments, the internal coating comprises copper or a copper alloy, wherein the copper and its alloy have antimicrobial properties. In some embodiments, the internal coating comprises at least one material selected from organosilanes, titanium dioxide, quaternary ammonium compounds, bactericides (e.g. chlorhexidine), viral inhibitors, and fungal inhibitors. In some embodiments, the device comprises a heat sink. In some embodiments, the heat sink comprises a passageway for receiving flow of a consumable. In some embodiments, the consumable is aerosolized while passing through the passageway of the heat sink. In some embodiments, the control system receives automatic updates. In some embodiments, an automatic update comprises a new cleaning cycle algorithm. In some embodiments, the device comprises at least one ultrasonic transducer for providing ultrasonic agitation of one or more articles inside the vacuum chamber.

In another aspect, disclosed herein are vacuum-based cleaning methods comprising: a) providing a vacuum chamber having an internal space with an internal pressure; b) providing an article to be cleaned, wherein said article is placed within the internal space of the chamber; c) run at least one cleaning cycle comprising: i) applying a vacuum source to the vacuum chamber, wherein the vacuum source reduces the internal pressure to a first pressure level, wherein the first pressure level is lower than ambient pressure outside the vacuum chamber; ii) maintaining the first pressure level for a period of time; and iii) raising the internal pressure to a second pressure level, wherein the second pressure level is higher than the first pressure level. In some embodiments, the vacuum source is a vacuum pump engaged with the vacuum chamber, wherein the vacuum pump is configured to remove gases from inside the vacuum chamber to lower the internal pressure. In some embodiments, the device is configured to clean at least one article disposed within the vacuum chamber, wherein said article is selected from the group consisting of clothing, linen, footwear, cushions, pillows, bags, purses, toys, and containers. In some embodiments, the device is configured to clean clothing. In some embodiments, the device is configured to clean toys. In some embodiments, the device is configured for removing stains from at least one article disposed within the vacuum chamber In some embodiments, the cleaning compound is stored as a compressed liquid, wherein the cleaning compound is a gas at room temperature and 1 atmospheric pressure. In some embodiments, the cleaning compound is stored within a detachable cartridge configured to engage with a bracket, slot, or chamber of the subsystem. In some embodiments, the subsystem comprises a reservoir for storing at least one cleaning compound. In some embodiments, the cleaning compound is a liquid having a latent heat of evaporation. In some embodiments, the liquid cleaning compound has a latent heat of evaporation of less than kJ/kg, less than 900 kJ/kg, less than 800 kJ/kg, less than 700 kJ/kg, less than 600 kJ/kg, less than 500 kJ/kg, less than 400 kJ/kg, less than 300 kJ/kg, less than 200 kJ/kg, less than 100 kJ/kg, less than 90 kJ/kg, less than 80 kJ/kg, less than 70 kJ/kg, less than 60 kJ/kg, less than 50 kJ/kg, less than 40 kJ/kg, less than 30 kJ/kg, less than 20 kJ/kg, or less than 10 kJ/kg. In some embodiments, the cleaning compound has a molecular weight below 330 g/mol, below 300 g/mol, below 250 g/mol, below 200 g/mol, below 150 g/mol, below 100 g/mol, below 50 g/mol, or below 30 g/mol. In some embodiments, the cleaning compound is selected from at least one of a detergent, a solvent, and PERC. In some embodiments, the device is configured to run for at least one cleaning cycle, wherein a cleaning cycle comprises: introducing at least one cleaning compound into the vacuum chamber, wherein the vacuum chamber vacuum lid is engaged with the opening to form a pressure seal prior to initiation of the cleaning cycle; incubating for a period of time; activating the vacuum pump to remove the at least one cleaning compound from the vacuum chamber. In some embodiments, the vacuum lid is adapted to engage with the opening of the vacuum chamber by means of a gasket, wherein the gasket is resistant to at least one of heat, ozone, weather, polar substances, aging, alkalis, acids, wear-and-tear, oxygenated solvents, and steam. In some embodiments, the device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min, 100 Torr/min, 150 Torr/min. 200 Torr/min, 250 Torr/min, 300 Torr/min, 350 Torr/min, 400 Torr/min, 450 Torr/min, 500 Torr/min, 550 Torr/min. 600 Torr/min, 650 Torr/min, 700 Torr/min. 750 Torr/min, 760 Torr/min, 800 Torr/min, 900 Torr/min, Torr/min, Torr/min, Torr/min, Torr/min, Torr/min, Torr/min, Torr/min, Torr/min, Torr/min, Torr/min, or Torr/min. In some embodiments, the device further comprises a consumables subsystem configured to introduce at least one consumable into the chamber before, during, or after a vacuum cycle. In some embodiments, the device further comprises a subsystem configured to introduce at least one gas into the vacuum chamber, wherein said gas is configured to carry out at least one of the following anti-odor functions: neutralizing odor, binding odor, dissolving odor, removing odor, and masking odor (e.g. by adding fragrance). In some embodiments, the gas is stored inside a cartridge configured to engage with the subsystem. In some embodiments, the gas is stored as a compressed liquid. In some embodiments, the vacuum chamber is configured to maintain a pressure seal when the subsystem injects one or more gases into the vacuum chamber, wherein the resulting internal pressure of the vacuum chamber is higher than external ambient pressure. In some embodiments, the device further comprises a single subsystem configured to receive one or more cartridges containing a gas with anti-odor functions, a disinfecting compound, or a consumable. In some embodiments, the vacuum chamber further comprises at least one spray nozzle engaged with the subsystem, wherein the spray nozzle is configured to disperse at least one of an anti-odor gas, a disinfecting compound, and a consumable into the vacuum chamber. In some embodiments, the device further comprises a control system having a processor and a user interface, wherein the control system is configured to accept instructions and operate the device based on said instructions. In some embodiments, the device further comprises at least one sensor disposed within the vacuum chamber, said sensor configured to function at sub-atmospheric pressure levels, wherein said at least one sensor is configured to measure at least one property selected from the group consisting of pressure, volatile organic compounds, relative humidity, dew-point, small particles, and temperature. In some embodiments, the device is configured to run for at least one cleaning cycle, wherein a cleaning cycle is selected from an asymptotic cycle, a storage cycle, and a margin cycle. In some embodiments, the control system comprises a software module for controlling the device, wherein the software module provides a cleaning objective, said cleaning objective being a preset objective, an algorithmically calculated objective, or a user entered objective. In some embodiments, the cleaning cycle objective is reducing the partial pressure of the cleaning compound in the vacuum chamber by a target percentage from an initial partial pressure, wherein the initial partial pressure is measured near the start of the cleaning cycle. In some embodiments, the device further comprises a heating subsystem configured to heat the vacuum chamber. In some embodiments, the control system operates the heating subsystem to enhance the vaporization of the cleaning compound inside the vacuum chamber without damaging any articles, wherein the internal temperature is no greater than 100 degrees Celsius, no greater than 90 degrees Celsius, no greater than 80 degrees Celsius, no greater than 70 degrees Celsius, no greater than 60 degrees Celsius, no greater than 50 degrees Celsius, no greater than 40 degrees Celsius, or no greater than 30 degrees Celsius. In some embodiments, the control system provides an interface for receiving user input to set the target temperature for the heating subsystem. In some embodiments, the device further comprises a mechanism for agitating the contents of the vacuum chamber. In some embodiments, the mechanism for agitation comprises a fan. In some embodiments, the vacuum chamber is configured to maintain a pressure seal with the vacuum lid when the internal pressure is lower than external pressure. In some embodiments, the vacuum chamber is configured to maintain a pressure seal with the vacuum lid when the internal pressure is higher than external pressure. In some embodiments, the device further comprises a latching mechanism, wherein the latching mechanism is configured to keep the vacuum lid engaged with the vacuum chamber before the internal pressure of the vacuum chamber is reduced, wherein the vacuum pressure generated by the negative internal pressure of the vacuum chamber maintains the pressure seal with the vacuum lid during a cleaning cycle. In some embodiments, the device further comprises an air filter for filtering the gases pumped out of the vacuum chamber by the vacuum source, said filter configured to collect at least one of airborne particles, odors, and the cleaning compound. In some embodiments, the air filter is a chemical air filter, a UV light air filter, an ionic air filter, or a particulate air filter. In some embodiments, the device further comprises a UV source configured to inactivate microbes located on an article disposed within the vacuum chamber. In some embodiments, the vacuum chamber comprises an internal coating configured to resist microbial growth. In some embodiments, the internal coating comprises copper or a copper alloy, wherein the copper and its alloy have antimicrobial properties. In some embodiments, the internal coating comprises at least one material selected from organosilanes, titanium dioxide, quaternary ammonium compounds, bactericides (e.g. chlorhexidine), viral inhibitors, and fungal inhibitors. In some embodiments, the device comprises a heat sink. In some embodiments, the heat sink comprises a passageway for receiving flow of a consumable. In some embodiments, the consumable is aerosolized while passing through the passageway of the heat sink. In some embodiments, the control system receives automatic updates. In some embodiments, an automatic update comprises a new cleaning cycle algorithm. In some embodiments, the device comprises at least one ultrasonic transducer for providing ultrasonic agitation of one or more articles inside the vacuum chamber.

in another aspect, disclosed herein are vacuum-based disinfecting methods comprising: a) providing a vacuum chamber having an internal space with an internal pressure: b) providing an article to be disinfected, wherein said article is placed within the internal space of the chamber; c) run at least one disinfecting cycle comprising: i) injecting a disinfecting gas into the internal space of the vacuum chamber, said gas having a partial pressure within the internal space; ii) applying a vacuum source to the vacuum chamber, wherein the vacuum source reduces the internal pressure of the vacuum chamber to below ambient pressure outside the vacuum chamber and reduces the partial pressure of the disinfecting gas; iii) maintaining the sub-atmospheric internal pressure for a period of time sufficient to achieve a cleaning objective; and iv) raising the internal pressure to atmospheric pressure. In some embodiments, the vacuum source is a vacuum pump engaged with the vacuum chamber, wherein the vacuum pump is configured to remove gases from inside the vacuum chamber to lower the internal pressure. In some embodiments, the device is configured to disinfect at least one article disposed within the vacuum chamber, wherein said article is selected from the group consisting of clothing, linen, footwear, cushions, pillows, bags, purses, toys, and containers. In some embodiments, the device is configured to disinfect footwear. In some embodiments, the device is configured to disinfect toys. In some embodiments, the disinfecting compound is stored as a compressed liquid, wherein the disinfecting compound is a gas at room temperature and 1 atmospheric pressure. In some embodiments, the disinfecting compound is stored within a detachable cartridge configured to engage with a bracket, slot, or chamber of the subsystem. In some embodiments, the subsystem comprises a reservoir for storing at least one disinfecting compound. In some embodiments, the disinfecting compound is a liquid at room temperature and 1 atmospheric pressure having a latent heat of evaporation. In some embodiments, the liquid disinfecting compound has a latent heat of evaporation of less than kJ/kg, less than 900 kJ/kg, less than 800 kJ/kg, less than 700 kJ/kg, less than 600 kJ/kg, less than 500 kJ/kg, less than 400 kJ/kg, less than 300 kJ/kg, less than 200 kJ/kg, less than 100 kJ/kg, less than 90 kJ/kg, less than 80 kJ/kg, less than 70 kJ/kg, less than 60 kJ/kg, less than 50 kJ/kg, less than 40 kJ/kg, less than 30 kJ/kg, less than 20 kJ/kg, or less than 10 kJ/kg. In some embodiments, the disinfecting compound has a molecular weight below 330 g/mol, below 300 g/mol, below 250 g/mol, below 200 g/mol, below 150 g/mol, below 100 g/mol, below 50 g/mol, or below 30 g/mol. In some embodiments, the disinfecting compound is selected from at least one of carbon dioxide, oxygen, ozone, chlorine dioxide, hydrogen peroxide, propylene glycol, triethylene glycol, and alcohol (e.g. ethanol, isopropanol, etc). In some embodiments, the device is configured to run for at least one disinfecting cycle, wherein a disinfecting cycle comprises: introducing one or more disinfectant compound into the vacuum chamber; incubating for a period of time suitable for disinfection of an article disposed within the vacuum chamber; and activating the vacuum pump to vaporize and remove the disinfectant compound from the vacuum chamber. In some embodiments, the vacuum lid is adapted to engage with the opening of the vacuum chamber by means of a gasket, wherein the gasket is resistant to at least one of heat, ozone, weather, polar substances, aging, alkalis, acids, wear-and-tear, oxygenated solvents, and steam. In some embodiments, the device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min. 100 Torr/min, 150 Torr/min, 200 Torr/min, 250 Torr/min, 300 Torr/min, 350 Torr/min, 400 Torr/min, 450 Torr/min, 500 Torr/min, 550 Torr/min, 600 Torr/min, 650 Torr/min, 700 Torr/min. 750 Torr/min, 760 Torr/min, 800 Torr/min, 900 Torr/min, Torr/min, Torr/min, Torr/min, Torr/min, Torr/min, Torr/min, Torr/min, Torr/min, Torr/min, Torr/min, or Torr/min. In some embodiments, the device further comprises a consumables subsystem configured to introduce at least one consumable into the chamber before, during, or after a vacuum cycle. In some embodiments, the device further comprises a subsystem configured to introduce at least one gas into the vacuum chamber, wherein said gas is configured to carry out at least one of the following anti-odor functions: neutralizing odor, binding odor, dissolving odor, removing odor, and masking odor (e.g. by adding fragrance). In some embodiments, the gas is stored inside a cartridge configured to engage with the subsystem. In some embodiments, the gas is stored as a compressed liquid. In some embodiments, the vacuum chamber is configured to maintain a pressure seal when the subsystem injects one or more gases into the vacuum chamber, wherein the resulting internal pressure of the vacuum chamber is higher than external ambient pressure. In some embodiments, the device further comprises a single subsystem configured to receive one or more cartridges containing a gas with anti-odor functions, a disinfecting compound, or a consumable. In some embodiments, the vacuum chamber further comprises at least one spray nozzle engaged with the subsystem, wherein the spray nozzle is configured to disperse at least one of an anti-odor gas, a disinfecting compound, and a consumable into the vacuum chamber. In some embodiments, the device further comprises a control system having a processor and a user interface, wherein the control system is configured to accept instructions and operate the device based on said instructions. In some embodiments, the device further comprises at least one sensor disposed within the vacuum chamber, said sensor configured to function at sub-atmospheric pressure levels, wherein said at least one sensor is configured to measure at least one property selected from the group consisting of pressure, volatile organic compounds, relative humidity, dew-point, small particles, and temperature. In some embodiments, the device is configured to run for at least one cleaning cycle, wherein a cleaning cycle is selected from an asymptotic cycle, a storage cycle, and a margin cycle. In some embodiments, the control system comprises a software module for controlling the device, wherein the software module provides a cleaning objective, said cleaning objective being a preset objective, an algorithmically calculated objective, or a user entered objective. In some embodiments, the cleaning cycle objective is reducing the partial pressure of odor particles in the vacuum chamber by a target percentage from an initial partial pressure, wherein the initial partial pressure is measured before the start of the cleaning cycle. In some embodiments, the device further comprises a heating subsystem configured to heat the vacuum chamber. In some embodiments, the control system operates the heating subsystem to enhance the vaporization of odor molecules from an article disposed within the vacuum chamber without damaging the article, wherein the internal temperature is no greater than 100 degrees Celsius, no greater than 90 degrees Celsius, no greater than 80 degrees Celsius, no greater than 70 degrees Celsius, no greater than 60 degrees Celsius, no greater than 50 degrees Celsius, no greater than 40 degrees Celsius, or no greater than 30 degrees Celsius. In some embodiments, the control system provides an interface for receiving user input to set the target temperature for the heating subsystem. In some embodiments, the device further comprises a mechanism for agitating the contents of the vacuum chamber. In some embodiments, the mechanism for agitation comprises a fan. In some embodiments, the vacuum chamber is configured to maintain a pressure seal with the vacuum lid when the internal pressure is lower than external pressure. In some embodiments, the vacuum chamber is configured to maintain a pressure seal with the vacuum lid when the internal pressure is higher than external pressure. In some embodiments, the device further comprises a latching mechanism, wherein the latching mechanism is configured to keep the vacuum lid engaged with the vacuum chamber before the internal pressure of the vacuum chamber is reduced, wherein the vacuum pressure generated by the negative internal pressure of the vacuum chamber maintains the pressure seal with the vacuum lid during a cleaning cycle. In some embodiments, the device further comprises an air filter for filtering the gases pumped out of the vacuum chamber by the vacuum source, said filter configured to collect at least one of airborne particles, odors, and the disinfectant compound. In some embodiments, the air filter is a chemical air filter, a UV light air filter, an ionic air filter, or a particulate air filter. In some embodiments, the device further comprises a UV source configured to inactivate microbes located on an article disposed within the vacuum chamber. In some embodiments, the vacuum chamber comprises an internal coating configured to resist microbial growth. In some embodiments, the internal coating comprises copper or a copper alloy, wherein the copper and its alloy have antimicrobial properties. In some embodiments, the internal coating comprises at least one material selected from organosilanes, titanium dioxide, quaternary ammonium compounds, bactericides (e.g. chlorhexidine), viral inhibitors, and fungal inhibitors. In some embodiments, the device comprises a heat sink. In some embodiments, the heat sink comprises a passageway for receiving flow of a consumable. In some embodiments, the consumable is aerosolized while passing through the passageway of the heat sink. In some embodiments, the control system receives automatic updates. In some embodiments, an automatic update comprises a new cleaning cycle algorithm. In some embodiments, the device comprises at least one ultrasonic transducer for providing ultrasonic agitation of one or more articles inside the vacuum chamber.

In another aspect, disclosed herein are mobile cleaning services comprising: a) providing a vehicle having at least one vacuum-based cleaning device comprising: i) a vacuum chamber comprising a housing defining an internal space having an internal pressure and an opening; ii) a vacuum lid configured to engage with the opening; iii) a vacuum pump connected to the vacuum chamber, wherein the vacuum pump is configured to reduce the internal pressure by pumping gases out of the vacuum chamber; and iv) a pressure release valve configured to open at the end of a cleaning cycle, wherein opening the valve equilibrates the internal pressure of the vacuum chamber with external pressure; b) collecting at least one article to be cleaned; c) placing the at least one article inside the vacuum chamber and closing the vacuum lid; d) operating the vacuum chamber to run at least one cleaning cycle to clean the at least one article; and e) removing the at least one cleaned article from the vacuum chamber for pickup or delivery.

In another aspect, disclosed herein are vacuum-based cleaning devices comprising: a) a vacuum chamber comprising: i) a housing defining an internal space; ii) an opening; iii) a vacuum lid configured to engage with the opening; iv) a pressing mechanism, wherein the pressing mechanism is configured to remove wrinkles by pressing an article disposed within the internal space of the vacuum chamber; b) a vacuum pump engaged with the internal space of the vacuum chamber, wherein operation of the vacuum pump removes one or more gases from the internal space to an external space.

In another aspect, disclosed herein are vacuum-based devices adapted for use in space comprising: a) a vacuum chamber comprising: i) a housing defining an internal space; ii) an opening; iii) a vacuum lid configured to engage with the opening; iv) a valve configured to link the internal space to an external vacuum source; b) a vacuum source engaged with the valve; c) an adjustable vacuum regulator interposed between the valve and the vacuum source; wherein opening the regulator de-pressurizes the internal space; and d) a second valve configured to re-pressurize the vacuum chamber following de-pressurization.

in another aspect, disclosed herein are vacuum-based cleaning devices comprising: a) a vacuum chamber comprising: i) a body defining an internal space having an internal pressure; ii) wherein pressure outside the vacuum chamber defines an external pressure; iii) wherein the vacuum chamber is configured to resist warping of the housing when internal pressure is below or above external pressure; b) a vacuum lid adapted to maintain an airtight seal when engaged with the opening of the vacuum chamber; and c) a vacuum pump engaged with the vacuum chamber, wherein operation of the vacuum pump channels gas out of the vacuum chamber; and d) a subsystem configured to introduce at least one compound into the vacuum chamber; wherein the partial vacuum enhances vaporization of odor molecules from an article disposed within said chamber, wherein said odor molecules exit the chamber by operation of the vacuum pump.

BRIEF DESCRIPTION OF THE DRAWINGS

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

[he novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings.

Figure 1:
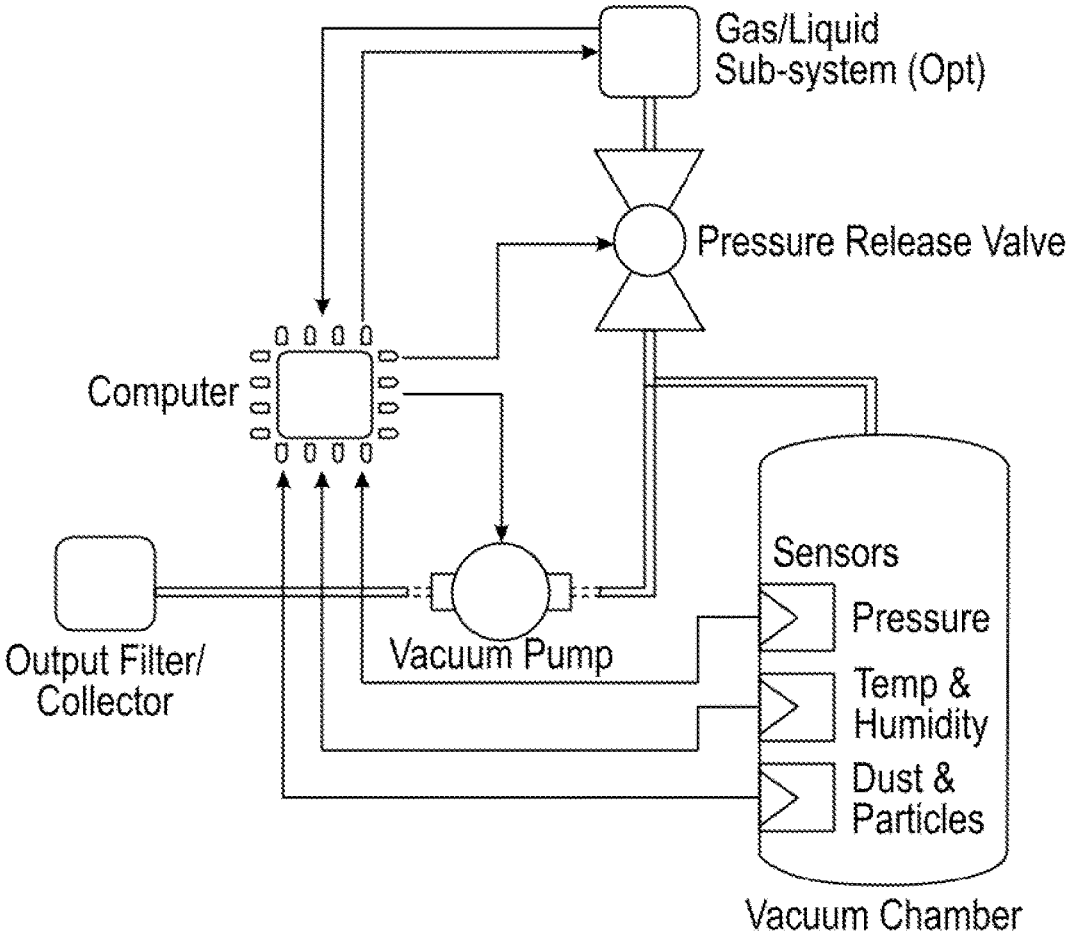

FIG. 1 shows a non-limiting diagram of the components for one embodiment of a vacuum-based device configured to remove odors from one or more articles placed inside the vacuum chamber of the device.

Figure 2:
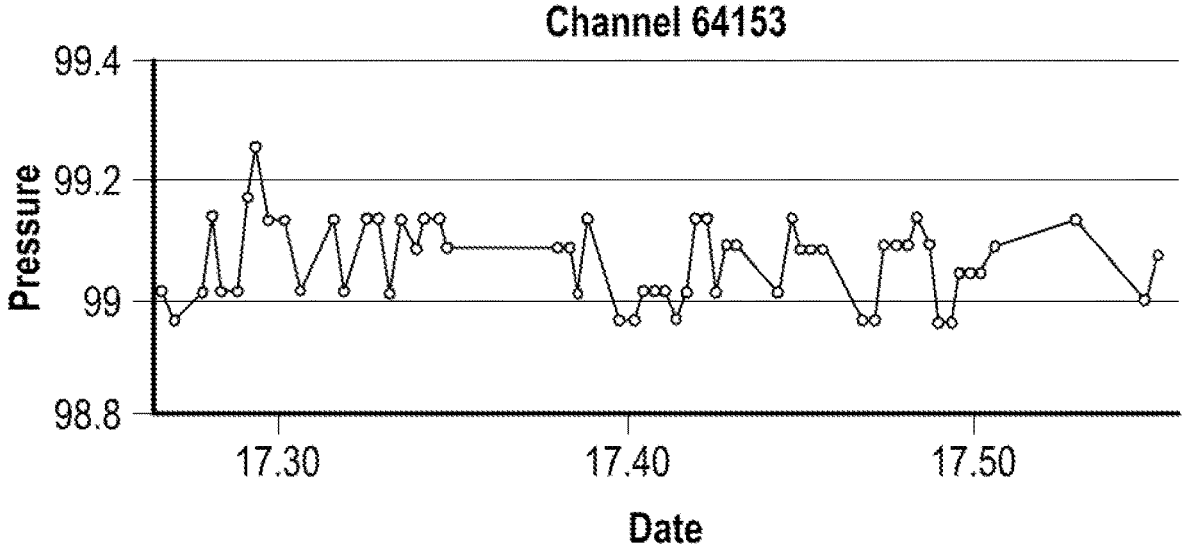

FIG. 2 is a graph displaying sensor data for pressure over time detected within the vacuum chamber of one embodiment of the vacuum-based device.

Figure 3:
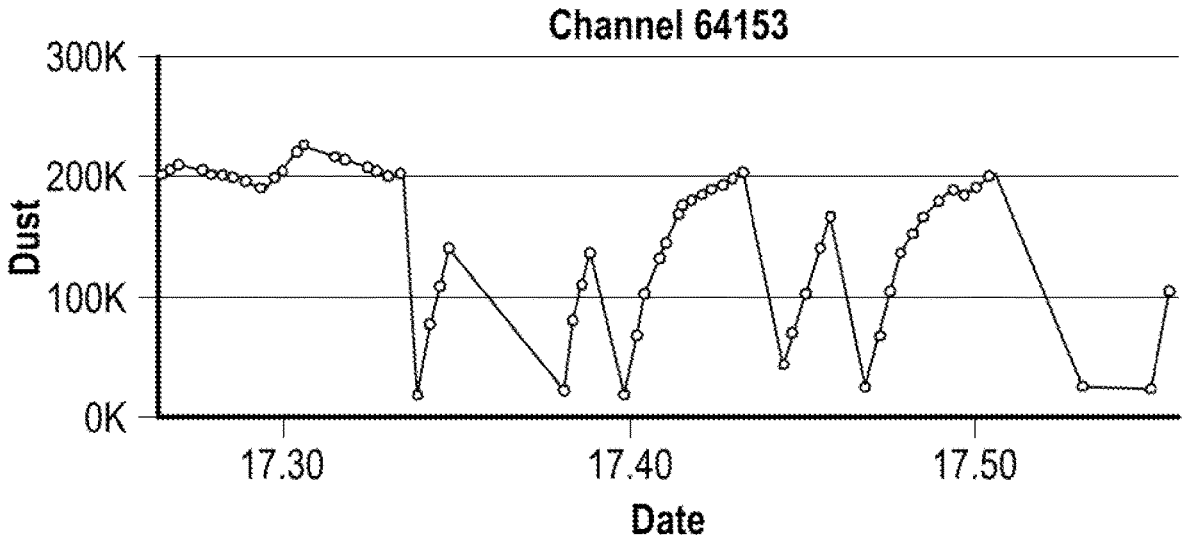

FIG. 3 is a graph displaying sensor data for dust over time detected within the vacuum chamber of one embodiment of the vacuum-based device.

Figure 4:
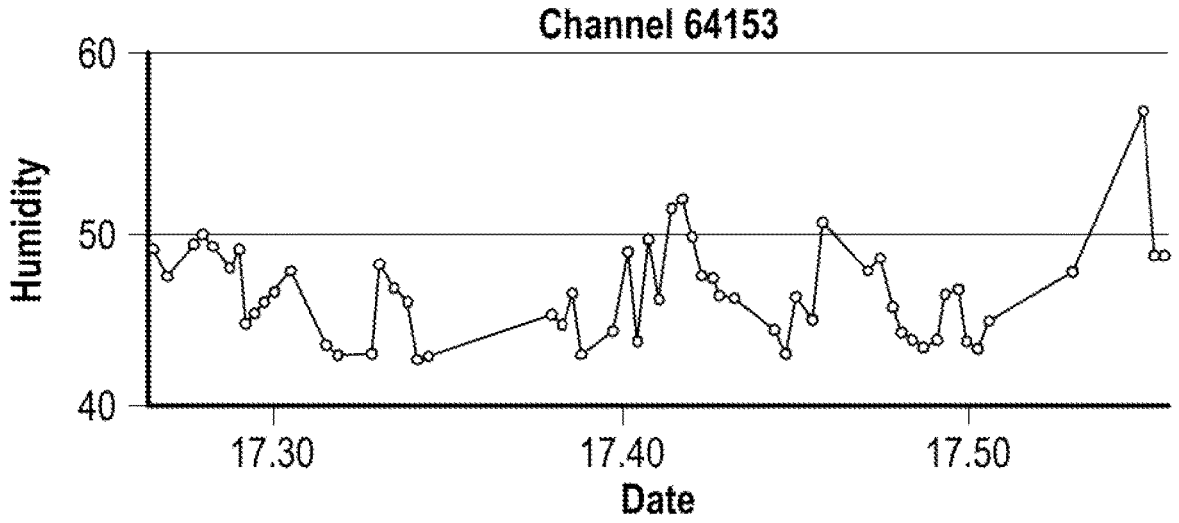

FIG. 4 is a graph displaying sensor data for humidity over time detected within the vacuum chamber of one embodiment of the vacuum-based device.

Figure 5:
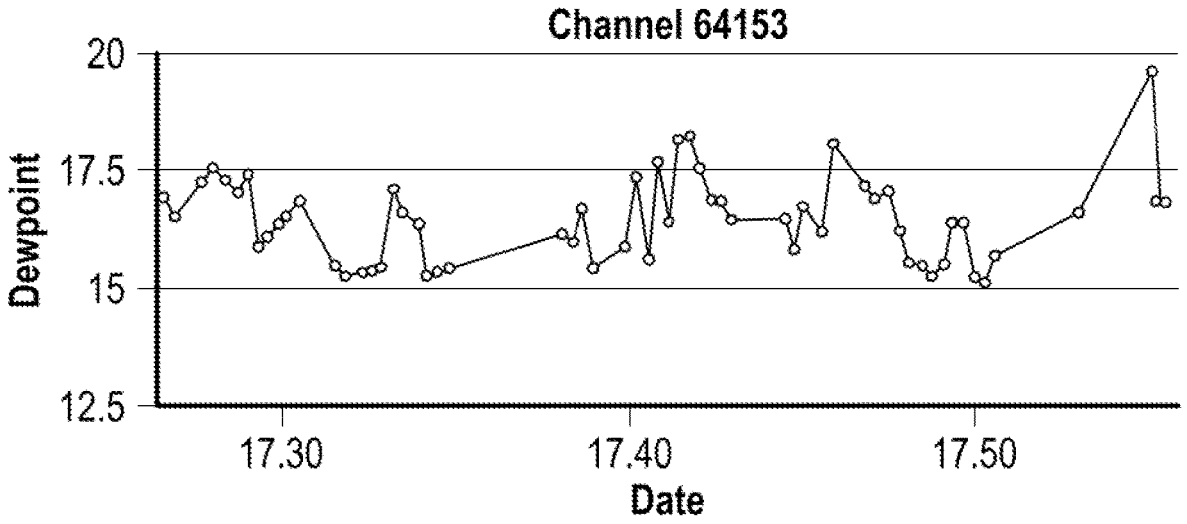

FIG. 5 is a graph displaying sensor data for dew point over time detected within the vacuum chamber of one embodiment of the vacuum-based device.

Figure 6:
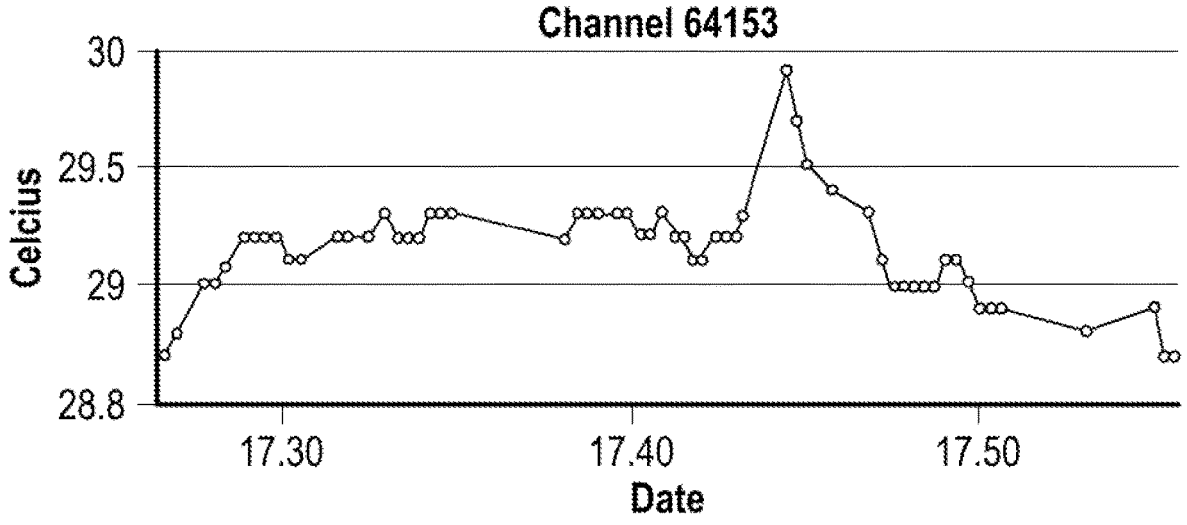

FIG. 6 is a graph displaying sensor data for temperature over time detected within the vacuum chamber of one embodiment of the vacuum-based device.

Figure 7:
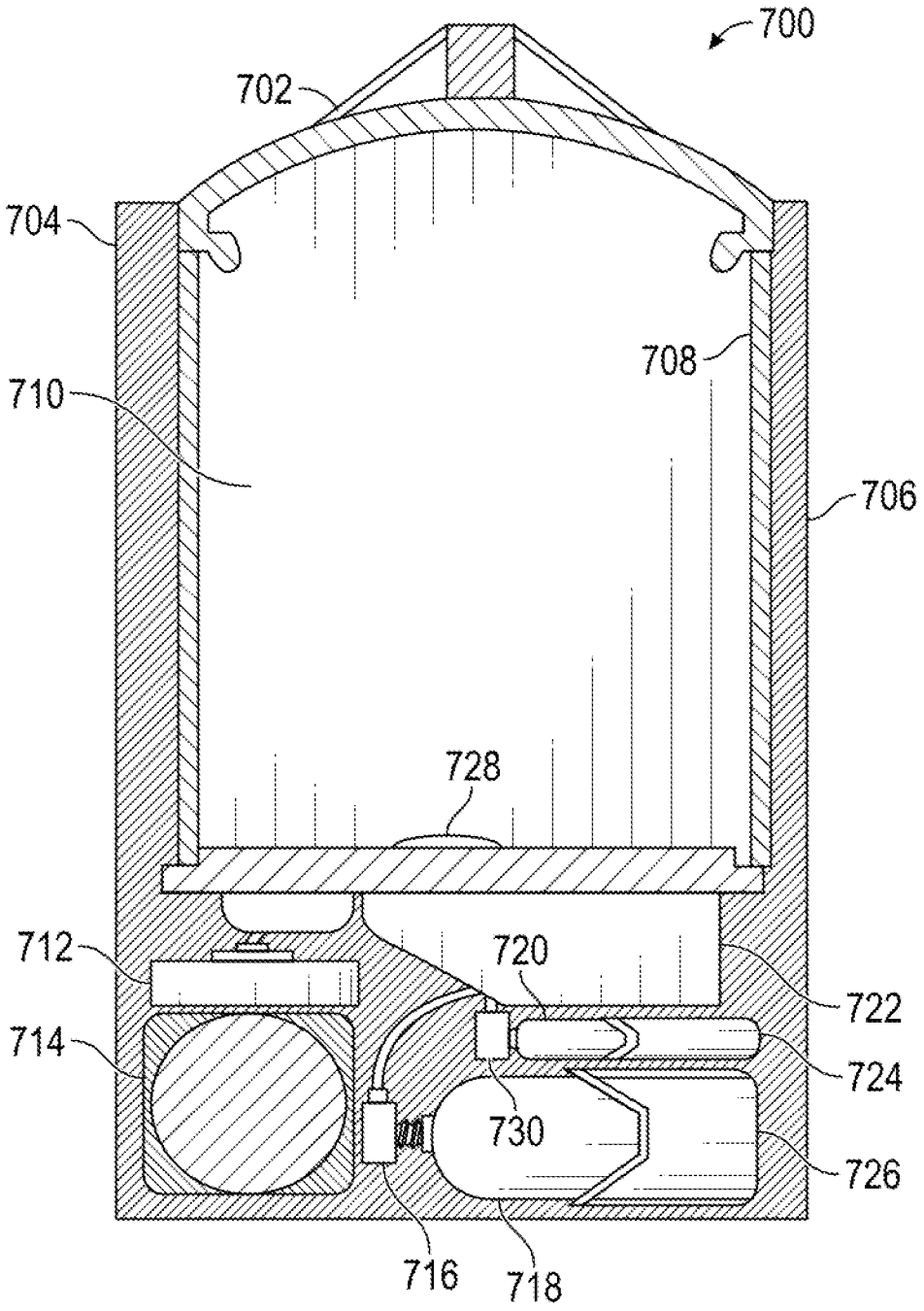

FIG. 7 illustrates a sectional side view of one embodiment of a vacuum-based device.

Figure 8:
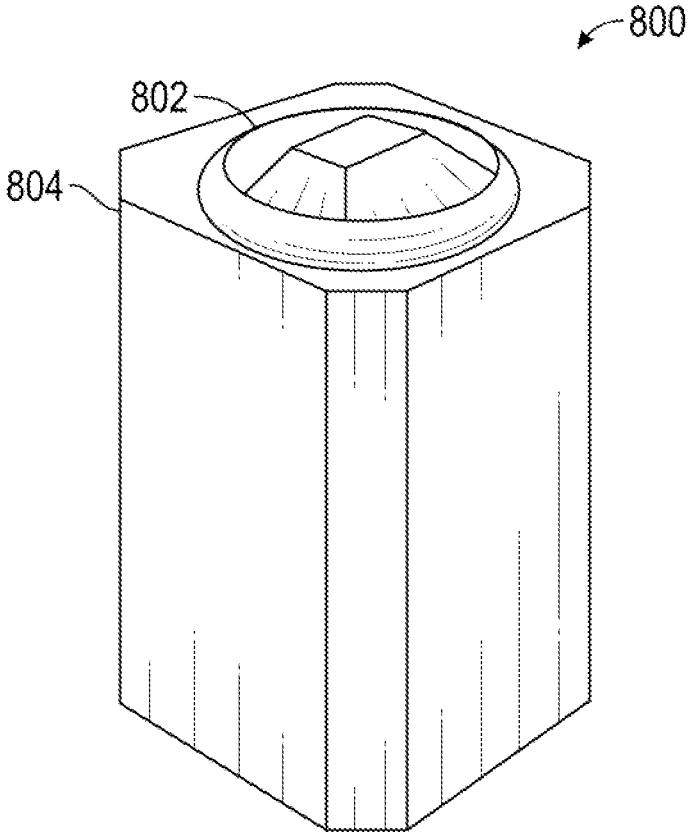

FIG. 8 illustrates a perspective view of one embodiment of a vacuum-based device with the lid closed.

Figure 9:
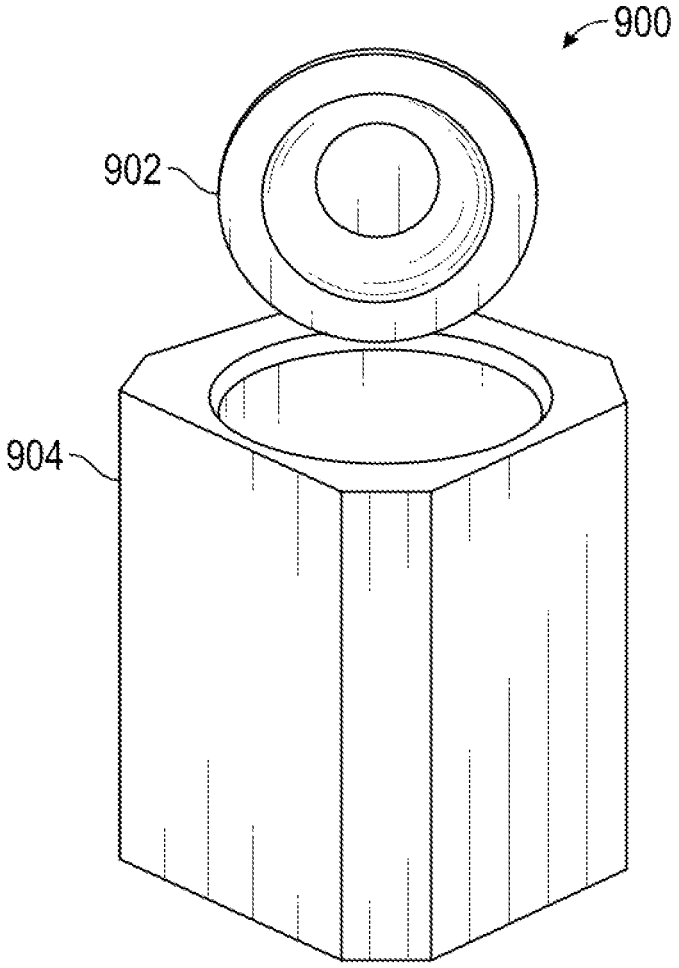

FIG. 9 illustrates a perspective view of one embodiment of the top half of a vacuum-based device with the lid opened.

Figure 10:
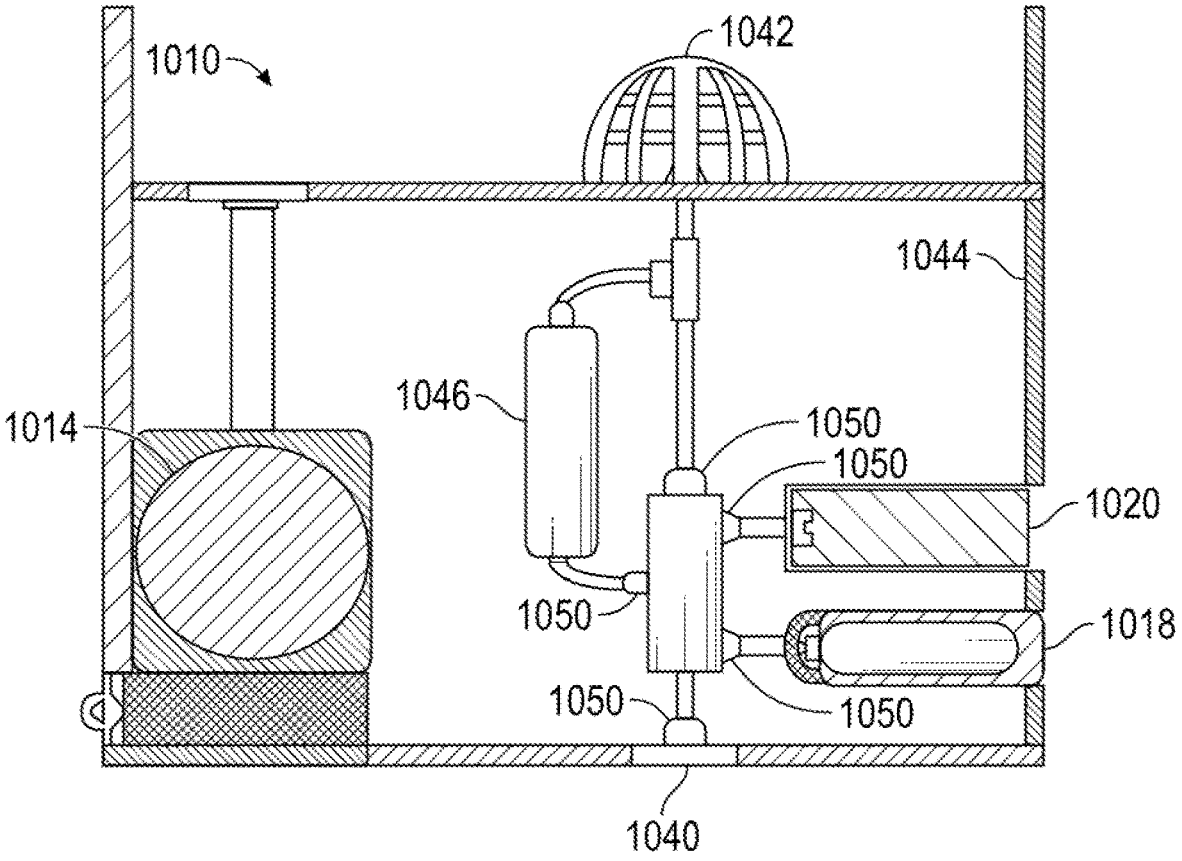

FIG. 10 illustrates one embodiment of a consumables system of the vacuum-based device.

Figure 11:
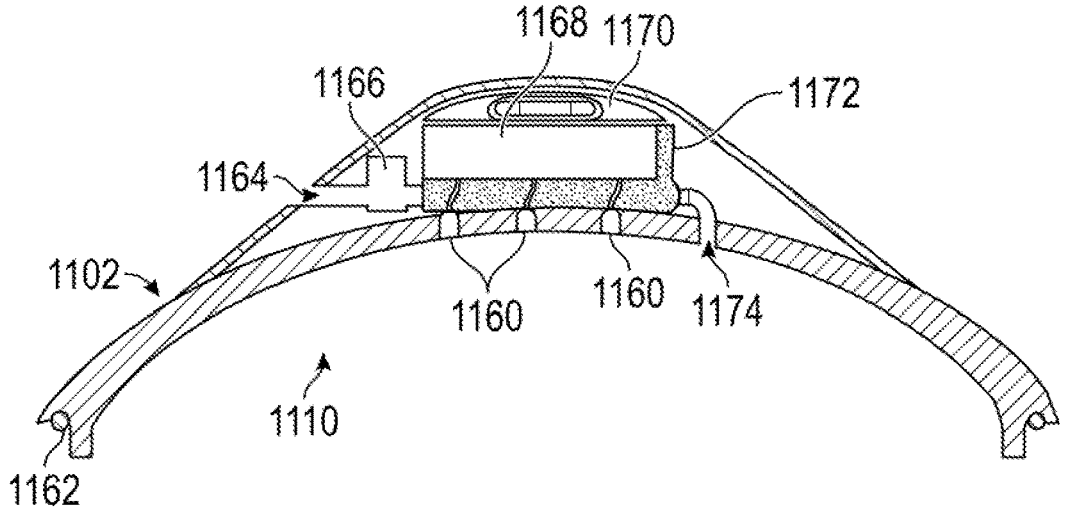

FIG. 11 illustrates a sectional side view of one embodiment of a vacuum lid.

Figure 12:
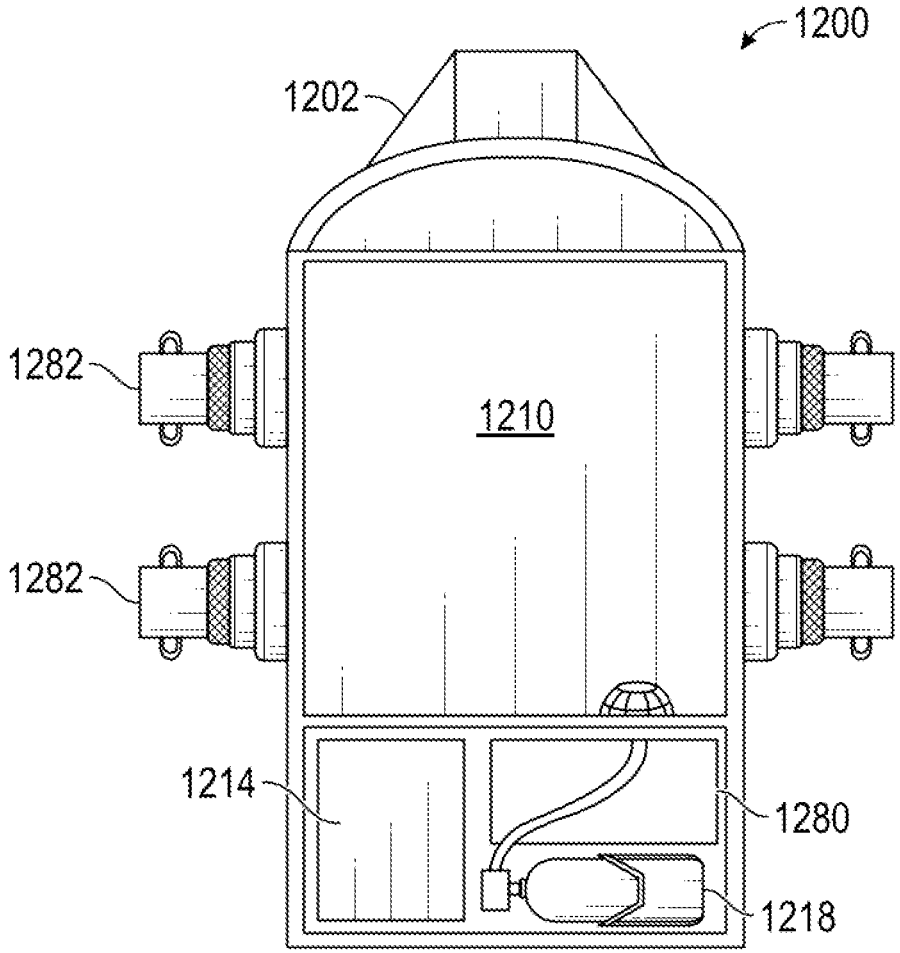

FIG. 12 illustrates a sectional side view of one embodiment of a vacuum-based device having ultrasonic transducers.

Figure 13:
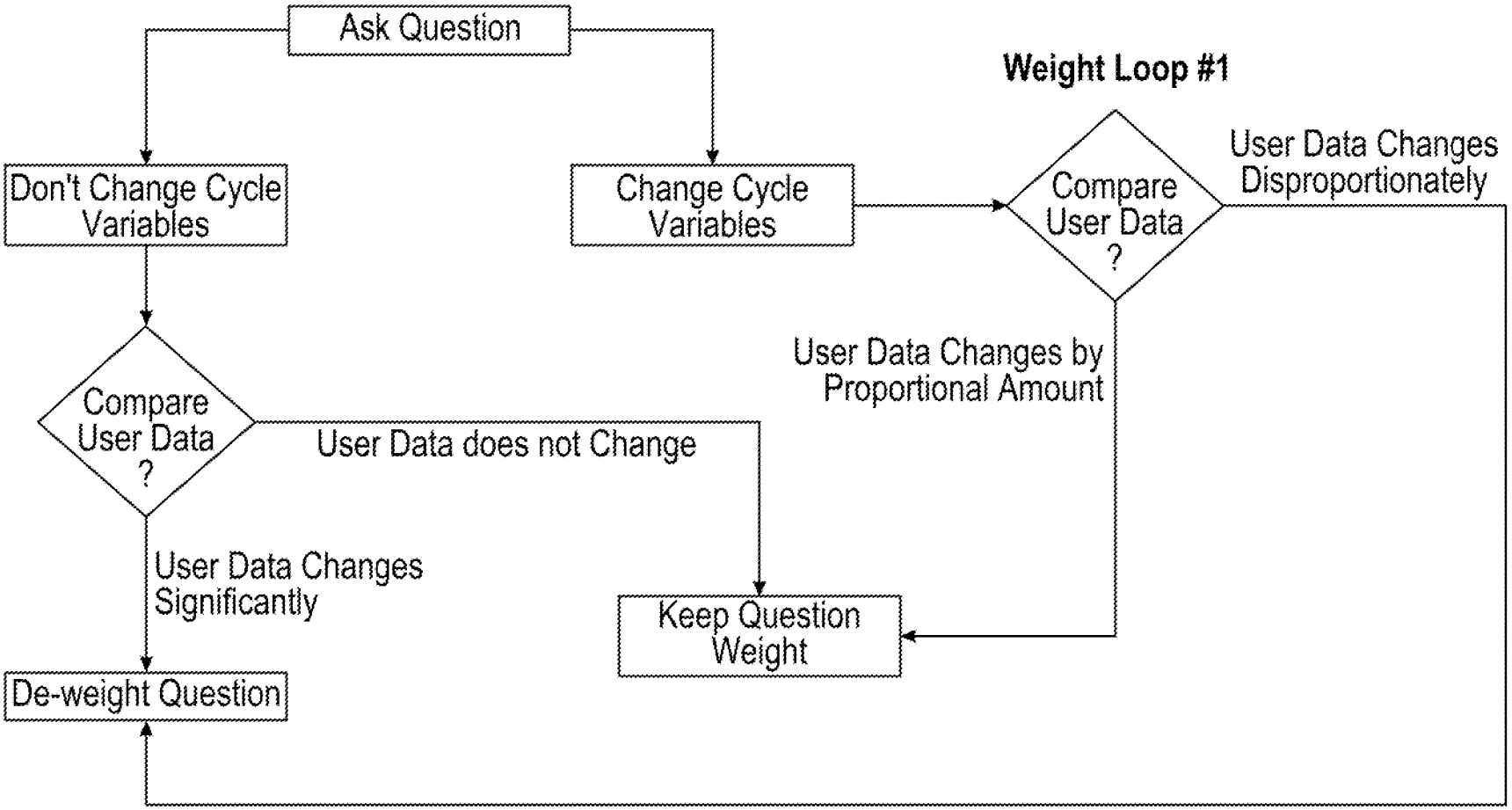

FIG. 13 illustrates a flow chart showing one embodiment of an algorithm for adjusting a cycle (e.g. cleaning cycle) based on user data and/or questions answered by a user.

Figure 14:
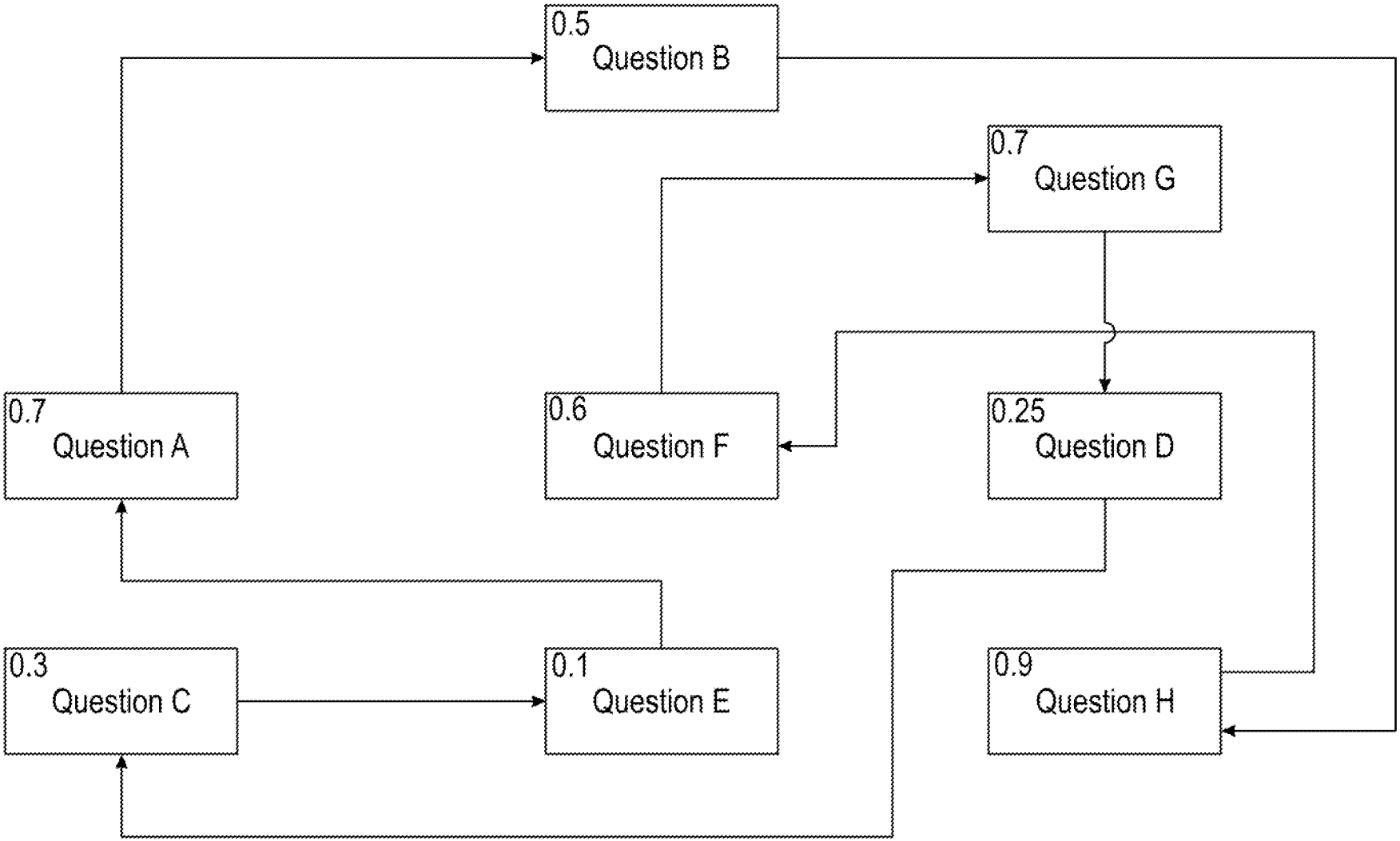

FIG. 14 illustrates a flow chart showing one embodiment of an algorithm with the weight (significance) associated with various questions used by the algorithm for adjusting a cycle.

Figure 15:
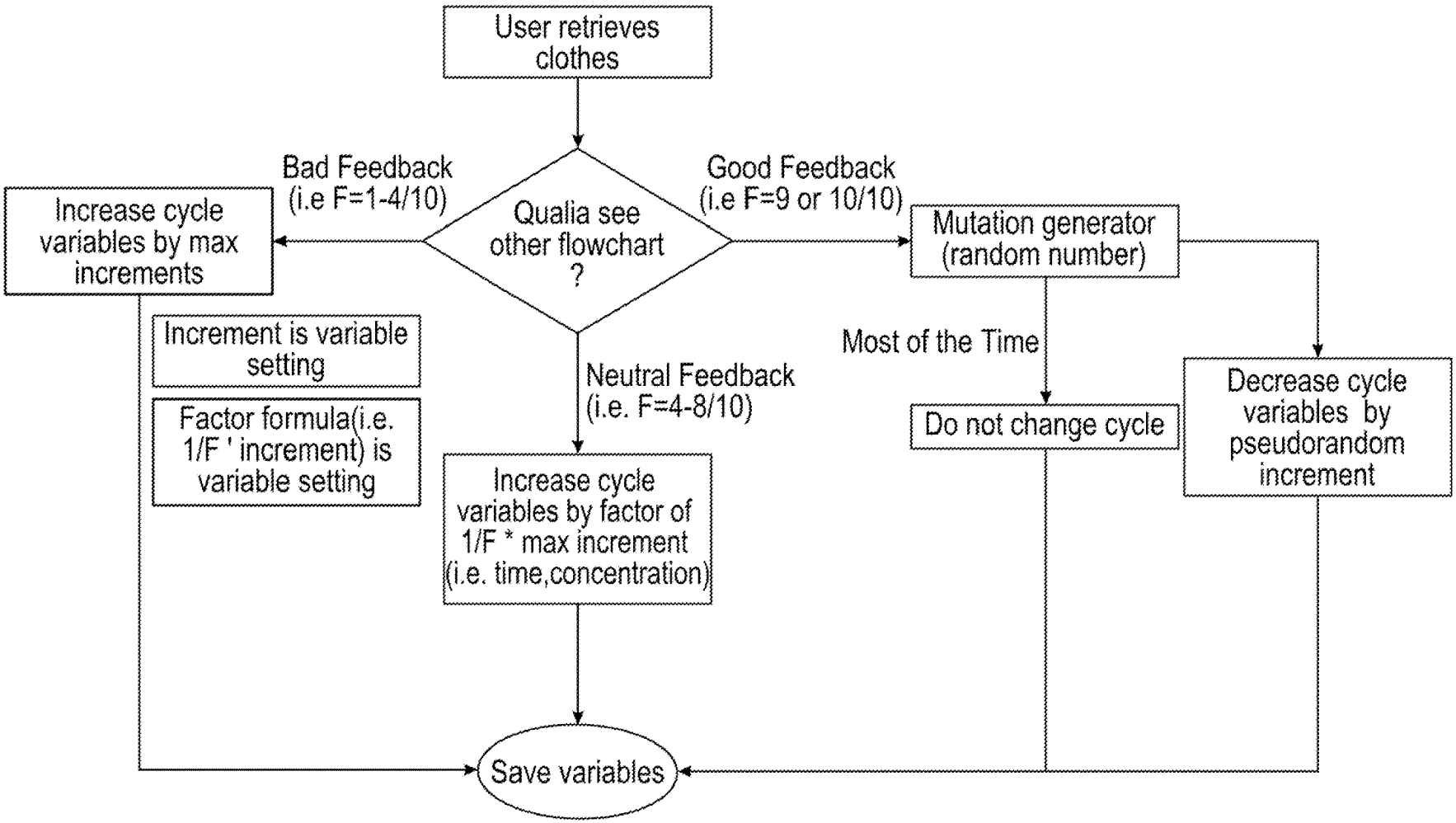

FIG. 15 illustrates a flow chart showing one embodiment of an algorithm for adjusting a cycle based on user feedback.

Figure 16:
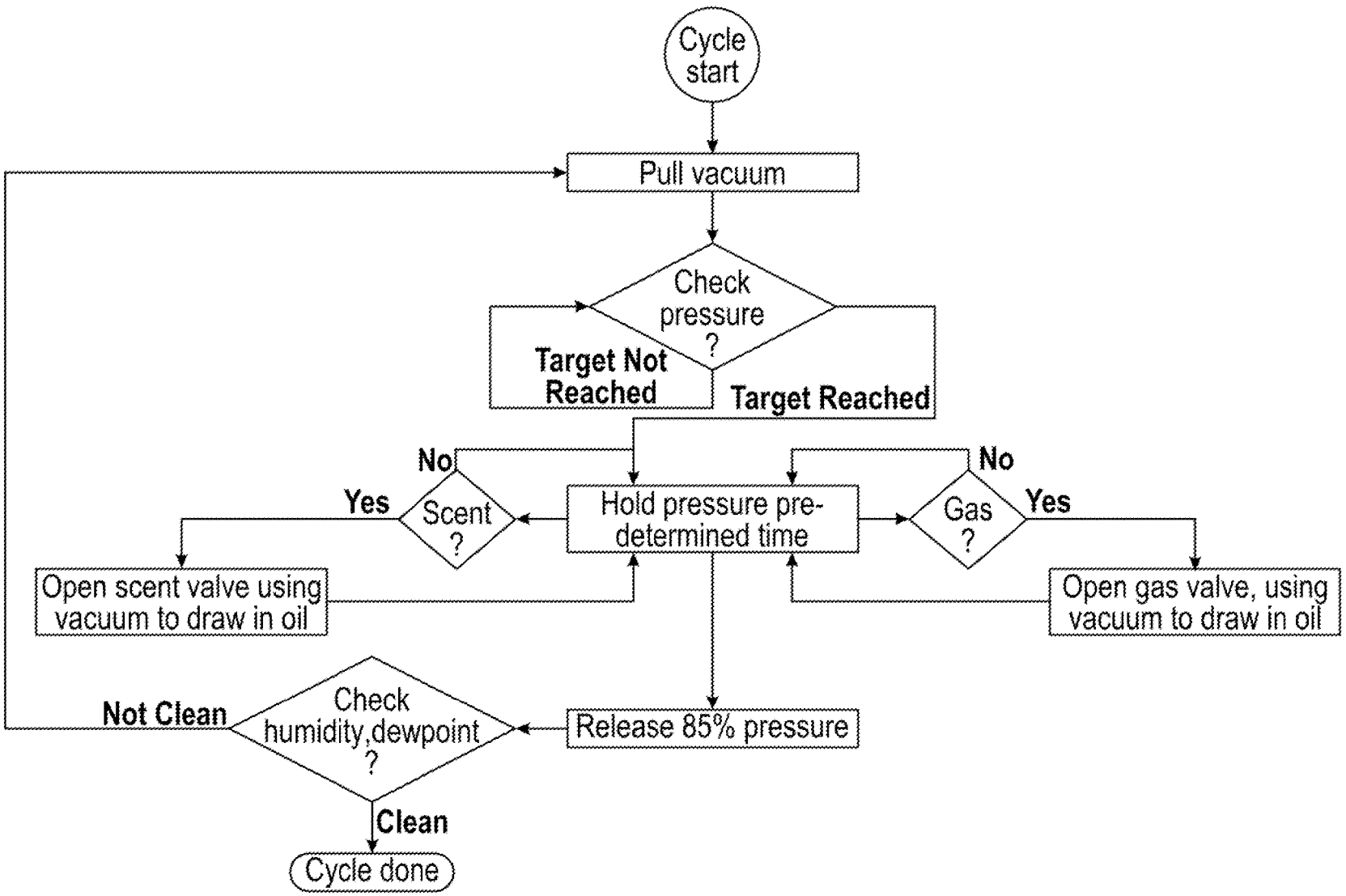

FIG. 16 illustrates a flow chart showing one embodiment of a cycle.

Figure 17:
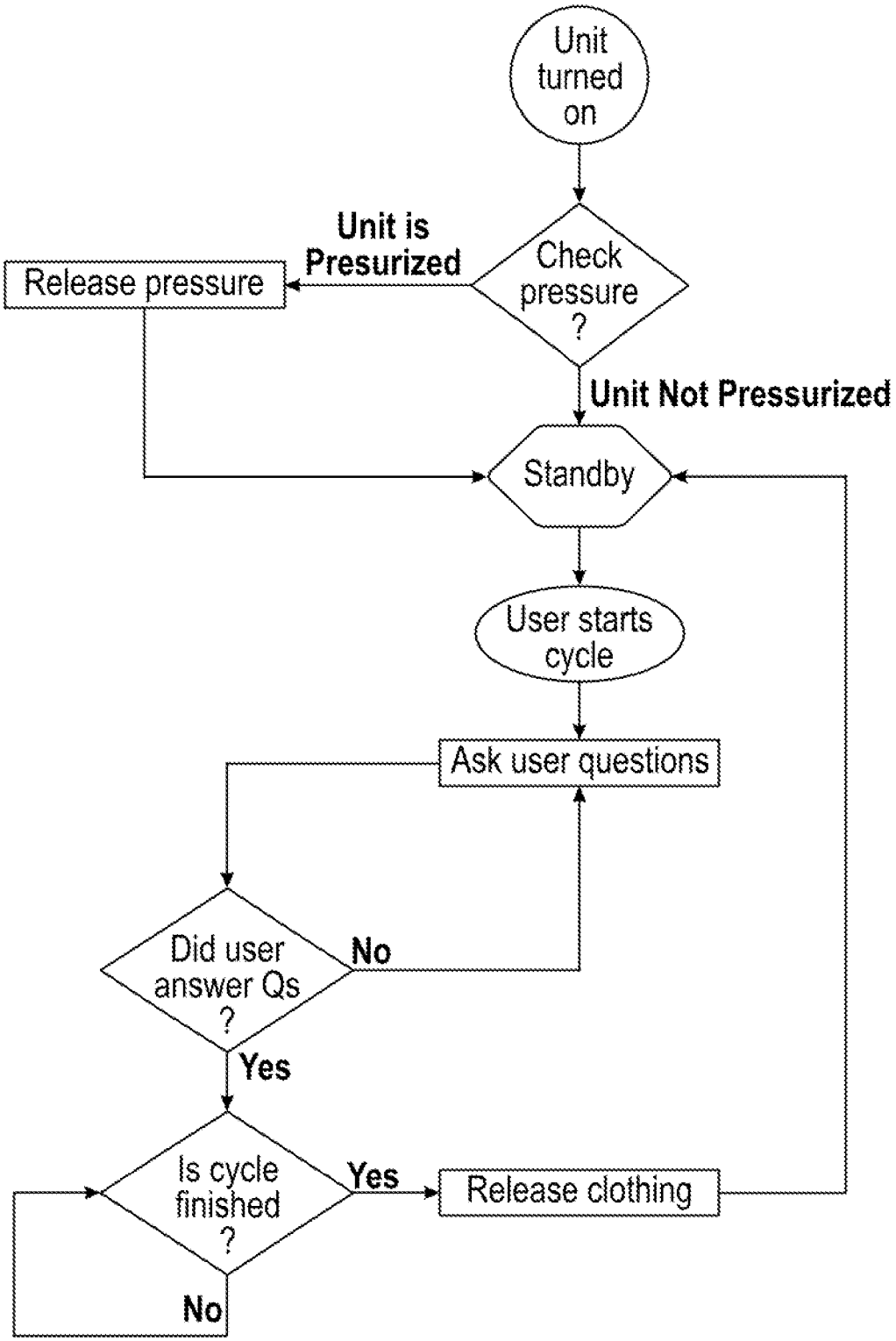

FIG. 17 illustrates a flow chart showing one embodiment of operation of a system, device, or method described herein.

DETAILED DESCRIPTION

Existing cleaning devices, systems, and methods fail to differentiate between the disparate kinds of "dirt" that need to be removed from dirty articles, and instead cleans all articles the same way by soaking them in a solvent containing a detergent or surfactant while adding mechanical agitation. As a result, people have been confined to time-consuming, energy inefficient, and waste-producing cleaning methods. Moreover, certain articles such as delicate clothing or shoes cannot even be cleaned using these traditional methods due to their fragility or vulnerability to solvents. Thus, a primary objective of the systems, products, devices, and methods for faster, energy efficient, and low waste cleaning described herein is to provide a vacuum-based technology for odor removal. Another objective of the systems, products, devices, and methods disclosed herein is to provide a vacuum-based technology for disinfecting articles. Another objective of the systems, products, devices, and methods disclosed herein is to provide a vacuum-based technology for removing dirts and/or stains from articles.

Disclosed herein, in certain embodiments, are vacuum-based devices configured to remove odors comprising: A vacuum-based odor-removing device comprising: a vacuum chamber comprising: a housing defining an internal space having an internal pressure; an opening; a vacuum lid adapted to engage with the opening of the vacuum chamber; and a vacuum source connected to the vacuum chamber, wherein operation of the vacuum source reduces the internal pressure of the internal space of the vacuum chamber.

Disclosed herein, in certain embodiments, are vacuum-based devices configured to disinfect comprising a vacuum chamber comprising: a housing defining an internal space having an internal pressure and an opening; a vacuum lid adapted to engage with the opening; a vacuum source engaged with the vacuum chamber, wherein the vacuum source is configured to remove gases from the internal space of the vacuum chamber; and a subsystem configured to release at least one disinfecting compound into the vacuum chamber.

Disclosed herein, in certain embodiments, are vacuum-based cleaning devices comprising: a vacuum chamber comprising: a housing defining an internal space having an internal pressure and an opening; a vacuum lid adapted to engage with the opening; a vacuum source engaged with the vacuum chamber, wherein the pump is configured to remove gases from the internal space of the vacuum chamber; and a subsystem configured to release at least one cleaning compound into the internal space of the vacuum chamber.

Disclosed herein, in certain embodiments, are vacuum-based odor-removing methods comprising: a) providing a vacuum-based cleaning device comprising: i) a vacuum chamber comprising a housing defining an internal space having an internal pressure; an opening; and a pressure release valve; ii) a vacuum lid adapted to engage with the opening of the vacuum chamber; iii) a vacuum pump connected to the vacuum chamber, said pump configured to remove gases from the internal space of the vacuum chamber; b) providing an article to be cleaned, wherein said article is placed within the internal space of the chamber; c) closing the vacuum lid, wherein the vacuum lid engages with the opening of the vacuum chamber to maintain an airtight seal; and d) turning on the vacuum pump, wherein operation of the vacuum pump reduces the internal pressure of the internal space of the vacuum chamber to sub-atmospheric levels; wherein the vacuum-based cleaning device removes odor molecules from the article by means of a partial vacuum generated by the reduction in internal pressure.

Disclosed herein, in certain embodiments, are vacuum-based cleaning methods comprising: a) providing a vacuum chamber having an internal space with an internal pressure; b) providing an article to be cleaned, wherein said article is placed within the internal space of the chamber; c) run at least one cleaning cycle comprising: i) applying a vacuum source to the vacuum chamber, wherein the vacuum source reduces the internal pressure to a first pressure level, wherein the first pressure level is lower than ambient pressure outside the vacuum chamber; ii) maintaining the first pressure level for a period of time; and iii) raising the internal pressure to a second pressure level, wherein the second pressure level is higher than the first pressure level.

Disclosed herein, in certain embodiments, are vacuum-based disinfecting methods comprising: a) providing a vacuum chamber having an internal space with an internal pressure; b) providing an article to be disinfected, wherein said article is placed within the internal space of the chamber; c) run at least one disinfecting cycle comprising: i) injecting a disinfecting gas into the internal space of the vacuum chamber, said gas having a partial pressure within the internal space; ii) applying a vacuum source to the vacuum chamber, wherein the vacuum source reduces the internal pressure of the vacuum chamber to below ambient pressure outside the vacuum chamber and reduces the partial pressure of the disinfecting gas; iii) maintaining the sub-atmospheric internal pressure for a period of time sufficient to achieve a cleaning objective; and iv) raising the internal pressure to atmospheric pressure.

Disclosed herein, in certain embodiments, are mobile cleaning services comprising: a) providing a vehicle having at least one vacuum-based cleaning device comprising: i) a vacuum chamber comprising a housing defining an internal space having an internal pressure and an opening; ii) a vacuum lid configured to engage with the opening; iii) a vacuum pump connected to the vacuum chamber, wherein the vacuum pump is configured to reduce the internal pressure by pumping gases out of the vacuum chamber; and iv) a pressure release valve configured to open at the end of a cleaning cycle, wherein opening the valve equilibrates the internal pressure of the vacuum chamber with external pressure; b) collecting at least one article to be cleaned; c) placing the at least one article inside the vacuum chamber and closing the vacuum lid; d) operating the vacuum chamber to run at least one cleaning cycle to clean the at least one article; and e) removing the at least one cleaned article from the vacuum chamber for pickup or delivery.

Disclosed herein, in certain embodiments, are vacuum-based cleaning devices comprising: a) a vacuum chamber comprising: i) a housing defining an internal space; ii) an opening; iii) a vacuum lid configured to engage with the opening; iv) a pressing mechanism, wherein the pressing mechanism is configured to remove wrinkles by pressing an article disposed within the internal space of the vacuum chamber; b) a vacuum pump engaged with the internal space of the vacuum chamber, wherein operation of the vacuum pump removes one or more gases from the internal space to an external space.

Disclosed herein, in certain embodiments, are vacuum-based devices adapted for use in space comprising: a) a vacuum chamber comprising: i) a housing defining an internal space; ii) an opening; iii) a vacuum lid configured to engage with the opening; iv) a valve configured to link the internal space to an external vacuum source; b) a vacuum source engaged with the valve; c) an adjustable vacuum regulator interposed between the valve and the vacuum source; wherein opening the regulator de-pressurizes the internal space; and d) a second valve configured to re-pressurize the vacuum chamber following de-pressurization.

Disclosed herein, in certain embodiments, are vacuum-based cleaning devices comprising: a) a vacuum chamber comprising: i) a body defining an internal space having an internal pressure: ii) wherein pressure outside the vacuum chamber defines an external pressure; iii) wherein the vacuum chamber is configured to resist warping of the housing when internal pressure is below or above external pressure; b) a vacuum lid adapted to maintain an airtight seal when engaged with the opening of the vacuum chamber; and c) a vacuum pump engaged with the vacuum chamber, wherein operation of the vacuum pump channels gas out of the vacuum chamber; and d) a subsystem configured to introduce at least one compound into the vacuum chamber; wherein the partial vacuum enhances vaporization of odor molecules from an article disposed within said chamber, wherein said odor molecules exit the chamber by operation of the vacuum pump.

FIG. 1 illustrates a non-limiting embodiment of the systems, products, devices, and methods disclosed herein. The vacuum chamber is shown as a housing with internal sensors for detecting the internal space of the chamber. The vacuum chamber is further connected to a pressure release valve and a vacuum pump. An optional subsystem for injecting consumables, odor eliminating compounds, disinfecting compounds, and/or cleaning compounds is also shown as connected to the vacuum chamber. A filter is engaged with the vacuum pump for purposes of removing undesirable substances from the air, which include odors, consumables, disinfecting compounds, cleaning compounds, dust, and other substances. The control system comprises a computer or processor configured to control the components of the vacuum-based device. FIG. 1 shows that the computer is configured to operate the vacuum pump, the sensors, and the subsystem. In some embodiments, the computer is configured to operate the vacuum chamber. In some embodiments, the computer is configured to open or close the vacuum lid in response to user input.

FIG. 2 is a graph displaying sensor data for pressure over time detected within the vacuum chamber of one embodiment of the vacuum-based device. In some embodiments, the vacuum-based device comprises a sensor detecting air pressure within the chamber. In some embodiments, sensor data is obtained in real-time during a cleaning cycle.

FIG. 3 is a graph displaying sensor data for dust over time detected within the vacuum chamber of one embodiment of the vacuum-based device. In some embodiments, the vacuum-based device comprises a sensor detecting dust within the vacuum chamber. In some embodiments, sensor data is obtained in real-time during a cleaning cycle.

FIG. 4 is a graph displaying sensor data for humidity over time detected within the vacuum chamber of one embodiment of the vacuum-based device. In some embodiments, the vacuum-based device comprises a sensor detecting humidity within the vacuum chamber. In some embodiments, sensor data is obtained in real-time during a cleaning cycle.

FIG. 5 is a graph displaying sensor data for dew point over time detected within the vacuum chamber of one embodiment of the vacuum-based device. In some embodiments, the vacuum-based device comprises a sensor detecting dew point within the vacuum chamber. In some embodiments, sensor data is obtained in real-time during a cleaning cycle.

FIG. 6 is a graph displaying sensor data for temperature over time detected within the vacuum chamber of one embodiment of the vacuum-based device. In some embodiments, the vacuum-based device comprises a sensor detecting temperature within the vacuum chamber. In some embodiments, sensor data is obtained in real-time during a cleaning cycle.

FIG. 7 illustrates a sectional side view of one embodiment of a vacuum-based device 700. In this embodiment, the device comprises a vacuum lid 702 and a vacuum chamber 704. In some embodiments, the vacuum chamber is a hermetically sealed enclosure, optionally internally coated with an anti-microbial coating, a chemically inert coating, or a copper coating. The vacuum chamber housing can comprise an outer enclosure 706 and an inner lining 708, and define an internal space 710. In some embodiments, the lid comprises one or more of valves, sensors, circuit board, heat sink, heating elements, or cooling elements. In some embodiments, the device comprises a vacuum pump 714 and an associated vacuum pump valve 712. In some embodiments, the vacuum pump is engaged with the vacuum chamber so as to remove gases/air from the internal space of the vacuum chamber. In some embodiments, the device comprises a gas tank 720 placed within a gas tank holder 724, and an associated valve 730. In some embodiments, the device comprises a scent tank 718 (e.g. storing a consumable that provides a pleasant scent, or disinfects, de-odorizes, etc.) placed within a scent tank holder 726, and an associated valve/regulator 716. In some embodiments, the gas is pressurized and released to help aerosolize or spread the consumable into the internal space of the vacuum chamber. In some embodiments, the device comprises a UV system 722 that directs UV light into the internal space of the vacuum chamber through a transparent section of the vacuum chamber 728.

FIG. 8 illustrates a perspective view of one embodiment of a vacuum-based device 800 comprising a vacuum lid 802 and a vacuum chamber 804, wherein the vacuum lid 802 is closed to provide a vacuum-tight seal. FIG. 9 illustrates a perspective view of one embodiment of the top half of a vacuum-based device 900 comprising a vacuum lid 902 and a vacuum chamber 904, wherein the vacuum lid 902 is closed to provide a vacuum-tight seal.

FIG. 10 illustrates one embodiment of a consumables system of the vacuum-based device that provides various functions described herein. In some embodiments, the vacuum-based device comprises one or more of a vacuum pump, a vacuum chamber, a protective screen at an air intake, a protective screen inside the vacuum chamber, a gas tank, a scent tank (e.g. a detachable cartridge holding a scent consumable), an ozone tank, and valves controlling the flow of gases into the vacuum chamber (e.g. solenoid valves). In some embodiments, as shown, the gas, cartridge, and vacuum chamber are all connected to the air intake. In some embodiments, the consumables system introduces ozone from the ozone tank into the vacuum chamber. In some embodiments, the consumables system introduces a fresh scent) from the scent tank into the vacuum chamber. In some embodiments, the consumables system uses a pressurized gas (e.g. $CO_2$) from the gas tank to disperse a consumable (e.g. scent from the scent tank) into the vacuum chamber. In some embodiments, contents of the scent tank (or alternatively, some other consumables tank holding a different consumable) are aerosolized by first creating a (partial) vacuum in vacuum chamber using the vacuum pump, then opening the air intake/inlet into the vacuum chamber, then releasing the cartridge valve in short bursts, drawing the contents into the high-pressure airflow that is running above it, into the vacuum chamber. In some embodiments, the gas tank releases a pressurized gas into the vacuum chamber via a solenoid valve. The protective screen helps prevent debris from flying in or out of the vacuum chamber. In some embodiments, this process is controlled by a control system (e.g. a microcontroller printed circuit board in the lid). In some embodiments, the device comprises one or more walls, wherein each wall is optionally insulted.

FIG. 11 illustrates a sectional side view of one embodiment of a vacuum lid. In some embodiments, the lid comprises a series of arches (e.g. repetitive arches) to provide structural support to improve the structural integrity of the lid while decreasing the weight of the lid (due to requiring less materials for same structural strength). In some embodiments, the lid is 3-D printed. In some embodiments, the vacuum lid comprises a seal (e.g. an O-ring seal) for forming a vacuum-tight seal with a vacuum chamber). In some embodiments, the vacuum lid comprises one or more sensors. In some embodiments, the vacuum lid comprises one or more of a control system (e.g. a microcontroller printed circuit board), a thermoelectric cooler, and a heat sink. In some embodiments, sensor electrical connections are run through the heat sink to the control system. In some embodiments, thermoelectric coolers are placed between the heat sink and the outside of the vacuum chamber or lid. When electricity is pumped through the thermoelectric cooler, one side pumps heat to the other side, cooling one side while heating the other side, one side really hot and the other side really cold. Reversing the electricity causes the heat to pump in the opposite direction, reversing the effect. In some embodiments, the vacuum lid comprises an air inlet receiving air from outside the vacuum chamber and directing the air to a chamber outlet where the air exits into the internal space of the vacuum chamber. In some embodiments, the air flow is controlled by a valve. In some embodiments, the air flows through a heat sink (e.g. a labyrinthine passageway in the heat sink) associated with the control system, wherein the heat sink heats up the air before it enters the vacuum chamber. In some embodiments, flow from a consumables system/subsystem is directed through the heat sink to be aerosolized or vaporized before entering the vacuum chamber.

FIG. 12 illustrates a sectional side view of one embodiment of a vacuum-based device having ultrasonic transducers. In some embodiments, the device comprises a vacuum lid and a vacuum chamber defining an internal space. In some embodiments, the device comprises one or more of a vacuum pump system, a gas tank system, and another optional system (e.g. consumables, UV, or oil subsystem). In some embodiments, the device comprises one or more ultrasonic transducers. In some embodiments, an ultrasonic transducer provides ultrasonic agitation of one or more articles disposed within the internal space of the vacuum chamber. In some embodiments, ultrasonic transducers are affixed in a repetitive pattern around the outside of the vacuum chamber. In some embodiments, the one or more ultrasonic transducers are connected to and controlled by the control system inside the vacuum lid.

FIG. 13 illustrates a flow chart showing one embodiment of an algorithm for adjusting a cycle (e.g. cleaning cycle) based on user data and/or questions answered by a user. The correlation between questions asked and overall user experience can be tested using a number of loops. In this embodiment, the loop asks a question, and delivers a specific experience based on the response/answer. Next time, it asks the same question, delivers the same experience, and if the user's response differs by a large amount, that question is de-weighted (it is less correlated with how the user actually feels). The question can be adjusted over time, for example, in case this de-weighted/less significant question was about smell, the next time, other smell related questions would take priority over this one.

FIG. 14 illustrates a flow chart showing one embodiment of an algorithm with the weight (significance) associated with various questions used by the algorithm for adjusting a cycle. In some embodiments, the device is programmed to poll a user with a randomized set of questions. Based on the answers to those questions, the device can decide which cycle peripherals to activate, and the intensity of those peripherals (e.g. time, pressure, and/or frequency of operation of vacuum pump, ultrasonic transducers, consumables system, etc) FIG. 15 illustrates a flow chart showing one embodiment of an algorithm for adjusting a cycle based on user feedback. For example, in some embodiments, if the user gives negative feedback on the cleanliness of the articles being cleaned by the previous cycle, the next cycle is intensified. If the user gives neutral feedback, in some embodiments, the cycle is intensified slightly for next time. In some embodiments, if the user gives positive feedback, the cycle is either left untouched, or de-intensified slightly for the next cycle.

FIG. 16 illustrates a flow chart showing one embodiment of a cycle. Once started, the vacuum chamber is evacuated (e.g. depressurized by a vacuum pump) to a desired threshold pressure. Once that pressure is reached, it is maintained for a period of time. Next, each of the peripherals/systems runs their loops in parallel (e.g. consumables system/subsystem). If they are set to activate, they will for pre-defined times. Whether the peripheral(s) is activated, and for how long can change with each cycle and is dependent on user answers to the questions asked. For example, in some embodiments, the questions asked center around how bad the clothes to be cleaned smell and/or how dirty they are. The device can then adjust whether or not to activate each component and for how long based on the answers.

FIG. 17 illustrates a flow chart showing one embodiment of operation of a system, device, or method described herein. After the device is turned on, it goes into standby until a cycle is started. Once a cycle is started (see FIG. 16), a user feedback loop begins asking questions. In some embodiments, a user will not be able to retrieve clothes until the questions are answered. In case of major failure, resetting the unit's power can also release clothes.

Certain Terminologies As used herein, odor refers to a smell or fragrance resulting from at least one volatilized chemical compound that is detectable by humans or other animals. Odor-causing chemical compounds include, but are not limited to, aldehydes, ketones, pheromones, esters, linear terpenes, cyclic terpenes, aromatic compounds, amines, alcohols, lactones, thiols, organophosphorus compounds, ethers, organosulfur and sulfide compounds, organic nitrogen compounds, ammonia, benzenes, phenols, epoxy resins, acids, anhydrides, hydrocarbons, solvents, chlorine, minerals, and metals.

s used herein, personal odor refers to scents or odors associated with volatile organic compounds ("VOC") emanating from the skin. VOCs from the skin come from several sources, including eccrine, sebaceous, and apocrine gland secretions as well as the interactions between these secretions with resident skin bacteria that metabolize components of the secretions to produce the odorous VOCs. Eccrine glands are the predominant sweat gland on the body and are located throughout the skin with particular concentration on the palms, soles, and the forehead. Sweat secreted from eccrine glands mostly consist of water and electrolytes, but can also include glycoproteins, lactic acid, sugars, and amino acids. Sebaceous gland secretions include cholesterol and cholesterol esters, fatty acids, squalene, and triglycerides, which provide a nutrient source for resident skin bacteria. Apocrine glands are located mostly in the axillae (armpits), areola, and the pubic region.

s used herein, volatile organized compounds ("VOCs") can include odorless compounds. Some volatilized compounds are detectable and can produce a physiological response without having a discernible scent. For example, some hormones may produce a physiological response upon detection by olfactory receptors while lacking a discernible scent.

s used herein, gas or gases refers to molecules in a gaseous state as one of the fundamental states of matter (e.g. gas, sovacuum lid, liquid, plasma). As used herein, gas can include homogeneous compositions of a particular molecule (e.g. pure oxygen) or heterogeneous mixtures which are composed of different kinds of molecules (e.g. air is composed of nitrogen, oxygen, carbon dioxide, etc.). As used herein, gas also refers to aerosols and other particles suspended in the air (e.g. dust, odors, etc.).

s used herein, "article" includes, but is not limited to, clothing, linen, footwear, cushions, pillows, bags, purses, toys, containers, food, and foodstuffs.

s used herein, laundry refers to any articles that are typically cleaned by traditional laundry cleaning methods such as use of a washing machine, dry cleaning, or hand washing.

s used herein, clothing refers to garments, hats, scarfs, gloves, belts, socks, and other items worn by a person or animal made from textiles, non-textile materials, or a combination thereof.

s used herein, footwear refers to shoes and other items worn on the foot, including but not limited to high heels, platform shoes, boots, sandals, flip-flops, moccasins, roller skates or roller blades, ice skates, ski boots, minimalist shoes (e.g. Vibram FiveFingers™), wrestling shoes, climbing shoes, cycling shoes, huaraches, dress shoes, ballet shoes, clogs, foam clogs (e.g. Crocs™), galoshes, and orthopedic footwear.

s used herein, toy refers to items used by children for play, including but not limited to stuffed animals, dolls, action figures, construction toys or bricks (e.g. wooden blocks, LEGO™), rubber toys, plastic toys, wooden toys, fabric toys, edible toys, animal chew toys, animal scratch toys (e.g. scratching post for cats), puzzles, mechanical toys, electronic toys (e.g. toy robot, Game Boy™), water toys (e.g. squirt gun, inflatable mattress), and accessories for said toys.

s used herein, external dirt refers to external oils, grease, bacteria, food, rust, odors, odorant molecules, fungi, smoke particles, and other unwanted matter that an article comes into contact with.

s used herein, a cleaning cycle refers to a sequence of one or more steps carried out by the systems, methods, and devices described herein for cleaning, de-odorizing, disinfecting, or otherwise removing undesirable dirt, odors, or stains from one or more articles. In some embodiments, a cleaning cycle refers to a de-odorizing (or odor removing) cycle and/or a disinfecting cycle.

s used herein, stain refers to the sources of personal odors, external odor sources, and external dirt that chemically bind to articles (e.g. stains from grass, blood, or urine).

s used herein, ambient pressure refers to the air pressure outside the vacuum chamber and is generally about 1 atmosphere. This ambient pressure may vary slightly depending on elevation and other factors. As used herein, ambient pressure is synonymous with atmospheric pressure.

s used herein, latent heat of evaporation refers to the energy required for a substance to transition from its liquid form into its gaseous form. Latent heat of evaporation is synonymous with latent heat of vaporization, enthalpy of vaporization, heat of vaporization, and heat of evaporation.

s used herein, structural failure refers to the collapse, breaking, tearing apart, fracturing, deformation, warping, shattering, cracking, or other damage of at least one component of the systems, devices, and apparatuses described in that renders the overall system, device, or apparatus inoperable. As an example, one form of structural failure is warping of the vacuum lid that creates a leak between the vacuum lid and the vacuum chamber and leads to a slowdown or inability of the vacuum system to regulate internal pressure.

Components Vacuum

Chamber The systems, products, devices, and methods disclosed herein include a vacuum chamber. In this "vacuum chamber" section of the specification, vacuum chamber refers to the combination of the vacuum chamber and the vacuum chamber vacuum lid. In some embodiments, the vacuum chamber is configured to withstand an internal pressure that is substantially different from the ambient pressure. The ambient pressure can vary depending on the environment. For example, ambient pressure may be different from 1 atmosphere inside of a space station, spaceship, a submarine or submersible, underwater station, at high altitude, on an airplane, or an environment where the pressure is artificially created and/or maintained. In some embodiments, the vacuum chamber is configured to withstand an internal pressure that is substantially lower than the ambient pressure. In some embodiments, the vacuum chamber is configured to withstand an internal pressure that is substantially higher than the ambient pressure. In other embodiments, the vacuum chamber is configured to withstand an internal pressure that is substantially higher or lower than the ambient pressure. An internal pressure that is substantially different from the ambient pressure indicates a pressure difference of at least 0.1 atm, or more preferably at least 0.2 atm, or more preferably at least 0.3 atm, or more preferably at least 0.4 atm, or more preferably at least 0.5 atm, or more preferably at least 0.6 atm, or more preferably at least 0.7 atm, or more preferably at least 0.8 atm, or more preferably at least 0.9 atm, or more preferably at least 1.0 atm, or more preferably at least 2.0 atm, or more preferably at least 3.0 atm, or more preferably at least 4.0 atm, or more preferably at least 5.0 atm, or more preferably at least 10 atm, or more preferably at least 15 atm, or more preferably at least 20 atm, or more preferably at least 25 atm, or more preferably at least 30 atm, or more preferably at least 35 atm. or more preferably at least 40 atm, or more preferably at least 45 atm, or more preferably at least 50 atm.

In some embodiments, the vacuum chamber is composed of one or more materials capable of withstanding significant pressure differences, high pressure environments, low pressure environments, or both high and low pressure environments. In some embodiments, the vacuum chamber is composed metals, non-metals, or a combination thereof. In some embodiments, the vacuum chamber is composed of at least one of a metal selected from the group consisting of stainless steel, mild steel, aluminum or an aluminum alloy, copper or a copper alloy, titanium or a titanium alloy, and another metal or its alloy. In some embodiments, the vacuum chamber is composed of at least one of a non-metal material selected from the group consisting of glass, acrylic, ceramic, high density ceramic, elastomers, polymers, composites, and plastics. In some embodiments, the vacuum chamber comprises a polypropylene copolymer.

Materials suitable for use in a vacuum environment can require a relatively low rate of outgassing depending on the degree of vacuum achieved. Outgassing is the release of a gas that has been dissolved, frozen, absorbed, or otherwise trapped within a material. Outgassing can occur by means of gas release from porous materials by means of evaporation, sublimation, or desorption. In some embodiments, the vacuum chamber is composed of at least one material suitable for use in a vacuum environment, wherein the material has an outgassing rate of preferably no more than 1×10-6, or more preferably no more than 1×10-7, or more preferably no more than 1×10-8, or more preferably no more than 1×10-9, or more preferably no more than 1×10-10, or more preferably no more than 1×10-11, or more preferably no more than 1×10-12 (Torr·l)/(sec·cm2) at room temperature and ambient pressure or 1 atm.

as can leak from or into the vacuum chamber due to leaks, cracks, imperfections in the seal between the vacuum chamber and the vacuum lid, imperfections in the gasket's ability to maintain a pressure seal, or structural failure of the vacuum chamber (e.g. the chamber or the vacuum lid collapses) due to substantial pressure differences between the internal pressure and the ambient pressure. In some embodiments, the vacuum chamber is configured to allow gas leakage preferably no greater than 1×10-6, or more preferably no greater than 1×10-7, or more preferably no greater than 1×10-8, or more preferably no greater than 1×10-9, or more preferably no greater than 1×10-10, or more preferably no greater than 1×10-11, or more preferably no greater than 1×10-12 (Torr·l)/(sec·cm2) at room temperature. In some embodiments, the vacuum chamber is configured to limit gas leakage from the vacuum chamber to preferably no more than 1×10-6, or more preferably no more than 1×10-7, or more preferably no more than 1×10-8, or more preferably no more than 1×10-9, or more preferably no more than 1×10-10, or more preferably no more than 1×10-11, or more preferably no more than 1×10-12 (Torr·l)(sec·cm2) at room temperature, wherein the internal pressure of the vacuum chamber is higher than ambient pressure. In some embodiments, the vacuum chamber is configured to limit gas leakage into the vacuum chamber to preferably no more than 1×10-6, or more preferably no more than 1×10-7, or more preferably no more than 1×10-8, or more preferably no more than 1×10-9, or more preferably no more than 1×10-10, or more preferably no more than 1×10-11, or more preferably no more than 1×10-12 (Torr·l)/(sec·cm2) at room temperature, wherein the internal pressure of the vacuum chamber is lower than ambient pressure by at least 0.1 atm, at least 0.2 atm, at least 0.3 atm, at least 0.4 atm, at least 0.5 atm, at least 0.6 atm, at least 0.7 atm, at least 0.8 atm, at least 0.9 atm, or at least 0.95 atm.

In some embodiments, the vacuum chamber is configured to have at least one support rib for providing support to the chamber structure. In some embodiments, the support rib has a horseshoe design, a horseshoe with strut design, a circular design, a semicircular design, a rectangular design, a rectangular design, a or a square design. In some embodiments, the vacuum chamber comprises support ribs located in the corners of the vacuum chamber. In some embodiments, wherein the vacuum chamber is manufactured by molding, the support ribs are structurally integrated into the vacuum chamber during the molding process as a single structure or are installed in the vacuum chamber after the chamber is manufactured. In some embodiments, the vacuum chamber and support ribs are manufactured by injection molding, blow molding, compression molding, extrusion molding, matrix molding, rotational molding, transfer molding, structural foam molding, or thermoforming.

In some embodiments, the vacuum chamber comprises an internal space defined by dimensions suitable for holding at least one article. In some embodiments, the internal space of the vacuum chamber has a volume of at least about 1, 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100, 110, 120, 130, 140, 150, 160, 170, 180, 190, 200, 250, 300, 350, 400, 450, 500, 600, 700, 800, 900, or cubic feet. In some embodiments, the internal space of the vacuum chamber has a volume of no more than about 1, 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90, 95, 100, 110, 120, 130, 140, 150, 160, 170, 180, 190, 200, 250, 300, 350, 400, 450, 500, 600, 700, 800, 900, or cubic feet. In some embodiments, the internal space of the vacuum chamber has a width of at least 1, 2, 3, 4, 5, 6, 7, 8, 9, 10, 15, 20, 25, 30, 35, 40, 45, or 50 feet. In some embodiments, the internal space of the vacuum chamber has a width of no more than 1, 2, 3, 4, 5, 6, 7, 8, 9, 10, 15, 20, 25, 30, 35, 40, 45, or 50 feet. In some embodiments, the internal space of the vacuum chamber has a length of at least 1, 2, 3, 4, 5, 6, 7, 8, 9, 10, 15, 20, 25, 30, 35, 40, 45, or 50 feet. In some embodiments, the internal space of the vacuum chamber has a length of no more than 1, 2, 3, 4, 5, 6, 7, 8, 9, 10, 15, 20, 25, 30, 35, 40, 45, or 50 feet. In some embodiments, the internal space of the vacuum chamber has a height of at least 1, 2, 3, 4, 5, 6, 7, 8, 9, 10, 15, 20, 25, 30, 35, 40, 45, or 50 feet. In some embodiments, the internal space of the vacuum chamber has a height of no more than 1, 2, 3, 4, 5, 6, 7, 8, 9, 10, 15, 20, 25, 30, 35, 40, 45, or 50 feet. In some embodiments, the internal space of the vacuum chamber has a bottom surface with a surface area of at least 1, 2, 3, 4, 5, 6, 7, 8, 9, 10, 15, 20, 25, 30, 35, 40, 45, or 50 square feet. In some embodiments, the internal space of the vacuum chamber has a top surface with a surface area of at least 1, 2, 3, 4, 5, 6, 7, 8, 9, 10, 15, 20, 25, 30, 35, 40, 45, or 50 square feet. In some embodiments, the chamber vacuum lid has a surface area of at least 1, 2, 3, 4, 5, 6, 7, 8, 9, 10, 15, 20, 25, 30, 35, 40, 45, or 50 square feet.

Disclosed herein, in certain embodiments, are vacuum-based devices comprising a vacuum chamber defining an internal space having an internal pressure and an opening, a vacuum lid configured to engage with the opening, a vacuum pump connected to the vacuum chamber, wherein the vacuum pump is configured to reduce the internal pressure of the vacuum chamber, wherein the vacuum chamber is configured to withstand internal pressure lower than ambient pressure outside the vacuum chamber, wherein gas leakage from the vacuum chamber is no more than 1×10-6 (Torr·l)/(sec·cm2) when the internal pressure is 0.4 atmospheres or below.

Vacuum Chamber Vacuum Lid

In some embodiments, the vacuum chamber vacuum lid is configured to engage with the opening of the vacuum chamber. In some embodiments, the vacuum lid is configured to engage with the opening of the vacuum chamber by means of a gasket, wherein the gasket provides a pressure seal between the vacuum chamber and the vacuum lid during operation of the vacuum-based device. In some embodiments, the vacuum lid is attached to the vacuum chamber. In some embodiments, the vacuum lid is attached to the vacuum chamber with a hinge joint. In some embodiments, the gasket is made of a material resistant to at least one of heat, ozone, weather, polar substances, aging, alkalis, acids, wear-and-tear, oxygenated solvents, and steam. In some embodiments, the gasket is selected from the group consisting of sheet gaskets, so vacuum lid material gaskets, spiral-wound gaskets, constant seating stress gaskets, double-jacketed gaskets, kamm profile gaskets, and flange gaskets. In some embodiments, the gasket is composed of at least one of rubber, silicone, metal, cork, felt, neoprene, nitrile rubber, fiberglass, polytetrafluoroethylene ("PTE") and a plastic polymer.

In some embodiments, the gasket is composed of ethylene propylene diene monomer ("EPDM"), wherein the gasket expands to fill a space in the presence of a partial vacuum inside the vacuum chamber. EPDM has been found to have properties especially well-suited for creating a strong vacuum seal, offering superior malleability compared to standard rubber gaskets. This malleability allows EPDM to expand under a vacuum to fill any gaps or cracks, including those caused by wear and tear. EPDM also has demonstrated outstanding resistance to heat, ozone, weather, polar substances, aging, alkalis, acids, oxygenated solvents, and steam. These properties make EPDM a particularly useful material for the gasket since some of the vacuum-based devices disclosed herein exert significant vacuum pressure and comprise subsystems for introducing consumables, gases, and other substances that are potentially sources of wear-and-tear to the vacuum chamber and/or the gasket.

In some embodiments, the vacuum lid is detachable from the vacuum chamber. In some embodiments, the detachable vacuum lid is detached from the vacuum chamber and replaced with a new detachable vacuum lid. For example, in some embodiments, the new detachable vacuum lid allows replacement of a defective or damaged vacuum lid without requiring replacement of the vacuum chamber. As another example, in some embodiments, the new detachable vacuum lid comprises upgraded hardware and/or software components to improve or increase functionality of the overall vacuum system. In some embodiments, the detachable vacuum lid is swapped out (e.g. replaced) without requiring replacement of the vacuum chamber. This functionality provides the added advantage of allowing hardware/software upgrades without replacing the entire system. Some benefits include reducing the amount of materials needed for upgrades or replacements, producing less waste (e.g. reusing the vacuum chamber rather than disposing of it as garbage or scrap), and reducing the shipping size of the upgraded or replacement parts (e.g. the detachable vacuum lid). In some embodiments, the vacuum chamber is configured for enhanced durability to provide long-term functionality. For example, the vacuum chamber is configured to minimize the risk of structural failure for at least 100, 200, 300, 400, 500, 600, 700, 800, 900, or 0 cleaning cycles. In some embodiments, minimizing the risk of structural failure refers to no more than a 0.001%, 0.01%, 0.05%, 0.10%, 0.5%, 1%, 1.5%, 2%, 2.5%, 30%, 3.5%, 4%, 4.5%, or 5% failure rate for at least 100, 200, 300, 400, 500, 600, 700, 800, 900, or 0 cleaning cycles. In some embodiments, minimizing the risk of structural failure refers to no more than a 0.001%, 0.01%, 0.05%, 0.1%, 0.5%, 1%, 1.5%, 2%, 2.5%, 3%, 3.5%, 4%, 4.5%, or 5% failure rate for at least 100, 200, 300, 400, 500, 600, 700, 800, 900, or 0 hours of low and/or high pressurization of the vacuum chamber. In some embodiments, the vacuum chamber has enhanced durability from using stronger and/or longer-lasting materials. As an example, in some embodiments, an enhanced vacuum chamber comprises a metal (e.g. stainless steel) instead of plastic.

In some embodiments, a vacuum system comprises a detachable chamber vacuum lid comprising at least one plastic that makes up at least 50%, 60%, 70%, 80%, 90%, or 95% of the vacuum lid. In further embodiments, the vacuum system comprises a vacuum chamber comprising at least one metal that makes up at least 50%, 60%, 70%, 80%, 90%, or 95% of the vacuum chamber. In some embodiments, when the vacuum system comprises a detachable vacuum lid comprising plastic and a vacuum chamber comprising metal, the detachable vacuum lid is upgraded about every 1, 2, 3, 4, 5, 6, 7, 8, 9, or 10 years. In some embodiments, the detachable vacuum lid is upgraded no more than about every 1, 2, 3, 4, 5, 6, 7, 8, 9, or 10 years. In further embodiments, when the vacuum system comprises a detachable vacuum lid comprising plastic and a vacuum chamber comprising metal, the vacuum chamber is upgraded about every 1, 2, 3, 4, 5, 6, 7, 8, 9, 10, 15, 20, 25, or 30 years. In some embodiments, the vacuum chamber is upgraded no more than about every 1, 2, 3, 4, 5, 6, 7, 8, 9, 10, 15, 20, 25, or 30 years. In some embodiments, the detachable vacuum lid and vacuum chamber are configured for the vacuum lid to be replaced more frequently than the vacuum chamber.

In some embodiments, the vacuum chamber vacuum lid comprises a housing for storing internal components. In some embodiments, the housing stores at least one system or subsystem. For example, in some embodiments, the housing comprises at least one of a vacuum pump, a sensor, a control system, an agitation system, a gas backfill system, cooling system, heating system, infusion system (e.g. oil/wax/enzyme infusion system), a disinfection system, positioning system, or other component of the vacuum system that is not the vacuum chamber.

In some embodiments, the vacuum chamber and/or the vacuum lid further comprises a latching mechanism configured to keep the vacuum lid engaged with the vacuum chamber before the internal pressure of the vacuum chamber is reduced. In some embodiments, the latching mechanism puts pressure on the vacuum lid to form a pressure seal with the vacuum chamber. Alternatively, the negative internal pressure inside the vacuum chamber generated by the vacuum pump provides sufficient suction to maintain a tight pressure seal between the vacuum chamber and the vacuum lid. In some embodiments, the latching mechanism does not maintain a tight pressure seal between the vacuum lid and vacuum chamber, wherein the pressure seal is provided by the negative internal pressure inside the vacuum chamber generated by the vacuum pump. In some embodiments, the latching mechanism is mechanical. In other embodiments, the latching mechanism comprises an electromagnetic latch.

In some embodiments, the vacuum chamber experiences positive internal pressure if a subsystem injects a pressurized gas or aerosol into the vacuum chamber when the vacuum lid is closed. In some cases, it is important that the vacuum lid remains sealed to prevent an injected gas or aerosol from escaping the vacuum chamber or to prevent the influx of outside atmospheric gases from entering the vacuum chamber. Therefore, in some embodiments, the vacuum chamber further comprises a latching mechanism configured to maintain an airtight pressure seal when the vacuum chamber has positive internal pressure. In some embodiments, the latching mechanism is configured to maintain an airtight pressure seal when the vacuum chamber has a positive internal pressure exceeding external pressure by at least 0.1 atm, at least 0.2 atm, at least 0.3 atm, at least 0.4 atm, at least 0.5 atm, at least 0.6 atm, at least 0.7 atm, at least 0.8 atm, at least 0.9 atm, at least 1.0 atm, at least 2.0 atm, at least 3.0 atm, at least 4.0 atm, at least 5.0 atm, at least 6.0 atm, at least 7.0 atm, at least 8.0 atm, at least 9.0 atm, at least 10 atm, at least 15 atm, at least 20 atm, at least 25 atm, at least 30 atm, at least 35 atm. at least 40 atm, at least 45 atm, at least 50 atm, or at least 60 atm. In some embodiments, the latching mechanism is automated. For example, in some embodiments, an automated latching mechanism engages before a cleaning cycle or program begins and/or disengages after the cleaning cycle or program has ended. In some embodiments, the automated latching mechanism is controlled by a control system.

In some embodiments, the chamber vacuum lid comprises a ribbed design for high strength resistance to high positive and/or negative pressure differentials within the internal space of the vacuum chamber. In some embodiments, the ribbed design provides high pressure resistance without structural failure while being composed of less material relative to a non-ribbed design providing the same high pressure resistance. In some embodiments, the chamber vacuum lid comprising a ribbed design has a lighter weight than a non-ribbed structure at the same high pressure resistance. In some embodiments, the chamber vacuum lid comprising a ribbed design weighs at least 5%, 10%, 15%, 20%, 25%, 30%, 35%, 40%, 45%, 50%, 60%, 70%, 80%, or 90% less than a corresponding non-ribbed chamber vacuum lid having the same high pressure resistance.

In some embodiments, the chamber vacuum lid is produced by 3D printing. In some embodiments, a 3D printed vacuum lid comprises at least one of sheet metal, plastic, polymer, or a composite material. In some embodiments, a 3D printed vacuum lid comprises at least one of polyamide, resin, stainless steel, bronze, gold, silver, nickel steel, aluminum, nickel steel, titanium, ceramic, gypsum, polycarbonate, high density polyethylene (HDPE), acrylonitrile butadiene styrene (ABS), polylactic acid (PLA), polyvinyl alcohol (PVA), sintered powdered metal, carbon fiber, carbon nanotubes embedded in plastic, and graphene or graphene oxide embedded in plastic.

In some embodiments, the vacuum lid comprises a hollow structure. In some embodiments, the hollow structure allows the vacuum lid to be a lighter weight (reducing materials used) and to store internal components (e.g. sensors, control system, etc). In some embodiments, the vacuum lid comprises at least one arch on an inside surface. In some embodiments, the at least one arch on the inside surface provides structural strength under a pressure differential between the internal space of the vacuum chamber and the outside environment.

In some embodiments, the majority of the subsystems are embedded within the chamber vacuum lid, which can be swapped out for upgraded vacuum lids as they are released.

Vacuum Pump

The systems, products, devices, and methods disclosed herein include a vacuum source. In some embodiments, the vacuum source is a vacuum pump. The vacuum pump functions to remove gas molecules from the vacuum chamber, creating a partial or even complete vacuum in the process. In some embodiments, the vacuum pump is engaged with the vacuum chamber through a hose, tube, or pipe connecting the pump to an aperture on the chamber. In some embodiments, the vacuum seal between the vacuum pump and the aperture on the vacuum chamber is reinforced with PTFE or epoxy-based sealants to prevent leaks.

The vacuum pump can be selected from, but are not limited to, the following categories: positive displacement pumps, momentum transfer pumps, regenerative pumps, and entrapment pumps, venturi vacuum pumps, and steam ejector pumps. In some embodiments, the vacuum pump is a positive displacement pumps selected from the following group: rotary vane pump, diaphragm pump, liquid ring pump, piston pump, scroll pump, screw pump, wankel pump, external vane pump, roots blower pump, multistage roots pump, toepler pump, and lobe pump.

Disclosed herein, in certain embodiments, are vacuum-based devices comprising: a vacuum chamber defining an internal space having an internal pressure and an opening, a vacuum lid configured to engage with the opening, a vacuum pump connected to the vacuum chamber, wherein the vacuum pump is configured to reduce the internal pressure of the vacuum chamber. In certain embodiments, the vacuum pump is a diaphragm pump or a piston pump. In certain embodiments, the vacuum pump is configured to provide a flow rate of at least 5 Liters/min (lpm) at 1 atmosphere. In some embodiments, the vacuum pump is configured to provide a flow rate of preferably at least 10 lpm, or more preferably at least 15 lpm, more preferably at least 20 lpm, more preferably at least 25 lpm, more preferably at least 30 lpm, more preferably at least 35 lpm, more preferably at least 40 lpm, more preferably at least 45 lpm, more preferably at least 50 lpm, more preferably at least 60 lpm, or more preferably at least 70 lpm at 1 atmosphere.

Disclosed herein, in certain embodiments, are vacuum-based devices comprising a vacuum chamber comprising an internal space, an opening, a vacuum lid configured to engage with the opening, a vacuum pump configured to provide suction to the vacuum engage, wherein the vacuum pump is a diaphragmatic pump configured to provide a flow rate of at least 10 lpm at 1 atmosphere.

Control System In some embodiments, the systems, products, devices, and methods disclosed herein comprise a control system that operates the device in response to user input. In some embodiments, the control system comprises a computer, a microcontroller, a system on chip ("SOC"), or a microprocessor. In some embodiments, the control system is a digital processing device. The control system includes at least one hardware central processing unit ("CPU") that carries out the vacuum-based device's functions. The control system further comprises an operating system configured to perform executable instructions.

In some embodiments, the control system further comprises a memory device, a display, an input device, and optionally a sound output device. In some embodiments, the display is a user interface. In some embodiments, the user interface is a graphic user interface ("GUI"). In some embodiments, the control system is connected to a network. In some embodiments, the network is the Internet. In other embodiments, the network is an intranet. In some embodiments, the control system is an on-board system integrated into the vacuum-based device. Alternatively, in some embodiments, the control system is an external, non-integrated system that can include at least one of laptops, desktop computers, smartphones, PDAs, game consoles, tablets, servers, and cloud computing. In some embodiments, the control system is connected to a network, wherein the control system is configured to receive instructions over said network. In some embodiments, the control system is connected to a network, wherein the control system is configured to send one or more status reports over said network. In some embodiments, the one or more status reports are sent automatically over a network. In some embodiments, the one or more status reports are sent over the network in response to instructions received over the network. In some embodiments, the one or more status reports are sent over the network in response to instructions entered through the user interface of the vacuum-based device.

In some embodiments, the control system collects historical use data for one or more users. In some embodiments, the control system provides data storage for storing historical use data for one or more users. In some embodiments, the historical use data is stored on a hard drive. In other embodiments, the historical use data is saved using cloud storage. In some embodiments, the control system communicates the collected use history data for one or more users to a physically separate data storage unit. In some embodiments, the separate data storage unit is located external to the device. In some embodiments, the control system receives user input or user feedback from a user interface (e.g. UI on the vacuum system or a computer or digital processing device associated with the vacuum system such as a smart phone). In some embodiments, user feedback comprises user satisfaction with a cleaning cycle. In some embodiments, user feedback may be obtained in the form of questions or surveys presented to the user before, during, and/or after a cleaning cycle. As an example, a question presented to a user requests the user rate the effectiveness or satisfaction of a cleaning cycle. As another example, a user is presented with a set of three questions asking the user to rate the effectiveness of the cleaning cycle, satisfaction with the cleaning cycle, and whether the user is satisfied with the fragrance added to the article during the cleaning cycle. In some embodiments, the user is presented at least 1, 2, 3, 4, 5, 6, 7, 8, 9, or 10 questions. In some embodiments, the user is presented with no more than 1, 2, 3, 4, 5, 6, 7, 8, 9, or 10 questions.

In some embodiments, the control system is configured to communicate over a network. In some embodiments, the control system communicates using at least one of Wi-Fi. Bluetooth, cellular, satellite, WiMAX, and ZigBee. In some embodiments, the control system communicates with at least one remote data server. In some embodiments, the control system sends data to the at least one remote data server. In some embodiments, data sent to a remote data server includes at least one of historical use data, customer data, and cleaning cycle data. In some embodiments, a remote data server receives data sent by at least one control system and stores it on a local memory and/or database. In some embodiments, the data received by a remote data server is stored on a temporary cache database or memory. In some embodiments, the data received by a remote data server is stored on a long-term database or memory. In some embodiments, the remote data server stores server data comprising at least one of software updates or upgrades, diagnostics, questions for a user, and news (e.g. product news). In some embodiments, the control system obtains server data comprising at least one of software updates or upgrades, diagnostics, questions for a user, and news from at least one remote data server. In some embodiments, the control system transmits data to at least one remote server (e.g. customer data) and obtains server data from the at least one remote server (e.g. product software upgrade).

in some embodiments, the control system comprises at least one algorithm used in carrying out a cleaning cycle. In some embodiments, the control system comprises at least one algorithm used in detecting cleanliness of an article before, during, and/or after a cleaning cycle. In some embodiments, an algorithm is updated using at least one of historical use data, customer data, and cleaning cycle data. In some embodiments, an algorithm is self-learning. In some embodiments, an algorithm comprises at least one feedback loop for providing a personalized cleaning experience. As an example, an algorithm for carrying out a cleaning cycle is updated based on customer data comprising responses to questions indicating the user felt the cleaned article had too strong of a fragrance added at the end of the cleaning cycle. In this example, the algorithm comprises a feedback loop for reducing the amount of a fragrant consumable to be used the next time the user selects this cleaning cycle based on the user's previous response that too much of the consumable was used in the previous cleaning cycle. In this manner, the algorithm is continually updated with use based on user feedback until the desired amount of fragrance is added to the article for this cleaning cycle. In some embodiments, the algorithms used in cleaning and/or detecting cleanliness are updated by the control system. In some embodiments, the algorithms are updated by at least one remote server. In some embodiments, the control system automatically connects with at least one remote server at regular intervals through any available, authorized communication channel (e.g. Wi-Fi at user's home or via a Bluetooth connection to the user's smartphone). In some embodiments, the control system comprises user adjustable settings for transmitting data to and/or receiving server data from a remote server. In some embodiments, an algorithm is continually updated with each cleaning cycle or additional information obtained by the control system (e.g. user answer to a question or update from a remote server).

In some embodiments, the control system further comprises at least one software module configured to run at least one cleaning cycle, wherein the cleaning cycle is a set of instructions provided to components of the vacuum-based device to effect cleaning of at least one article disposed within the vacuum chamber. In some embodiments, the cleaning cycle is selected from an asymptotic cycle, a storage cycle, and a margin cycle.

uring an asymptotic cycle, the control system runs the vacuum pump to reduce the internal pressure of the vacuum chamber to an achievable asymptotic limit, wherein the asymptotic limit is the lowest pressure the vacuum pump can maintain at a given pump rate (arising from a dynamic equilibrium between the pump rate and gas or air leakage from the vacuum chamber). After a period of time, the housing momentarily achieves this asymptotic pressure and the on-board computer immediately switches off the vacuum pump and opens a pressure release valve to at least partially re-pressurize the housing. Partial re-pressurization occurs whenever the pressure release valve is opened to raise the internal pressure of the vacuum chamber by at least 0.1 atm. This cycle of generating a vacuum to reach an asymptotic limit followed by re-pressurization is repeated while the control system continuously calculates the absolute humidity of the housing from the relative humidity and dew point. Upon successful dehydration of the housing's contents by a predefined amount, the computer ends the cycle and initiates full re-pressurization to ambient pressure of about 1 atm.

storage cycle is configured for storing at least one article inside a vacuum chamber when the user does not want to use the article immediately. This is useful for when the user would like to eliminate odors, neutralize bacteria, and dry items, but would also like to keep those items fresh until the next time that they actually want to use them. When the vacuum-based device disclosed herein is set to operate a storage cycle, the control system activates the vacuum pump to generate a partial vacuum in the vacuum chamber, wherein the internal pressure of said chamber is lower than 0.9 atm, lower than 0.8 atm, lower than 0.7 atm, lower than 0.6 atm, or lower than 0.5 atm. In some embodiments, the control system comprises a user interface, wherein the interface is configured to receive instructions for setting a storage pressure level. A user can therefore enter higher or lower storage pressure levels depending on the intensity of the odors the user is trying to remove. Alternatively, a user trying to dehydrate or dry a wet article may enter higher or lower storage pressure levels depending on the level of moisture. The control system is configured to maintain the storage pressure level, wherein the system momentarily turns on the vacuum pump when the pressure level rises to compensate for natural leakage over long periods of time. The control system maintains this storage pressure level for a period of time, wherein the period of time is preset or dynamically calculated to achieve a cleaning objective, wherein a user can access the control system to stop the storage cycle before the period of time is up.

margin cycle is configured to be energy efficient. Turning the vacuum pump on lower pressure when the chamber is already at a low pressure requires a great deal of energy. The marginal decrease in pressure requires more energy the lower the existing pressure. Furthermore, the bulk of the vaporization process for odors happens once the pressure is under a certain threshold for every compound. The aim of this cycle is to maximize odor vaporization and removal without wasting energy. A margin cycle begins when the vacuum pump lowers the internal pressure of the vacuum chamber down to a pressure that is below the vaporization threshold calculated for the odors based on past or current sensor data. In some embodiments of the margin cycle, a pressure release valve is then opened to partially or fully re-pressurize the vacuum chamber. This margin cycle is then repeated until a cleaning objective is achieved. In alternative embodiments of the margin cycle, after the internal pressure of the vacuum chamber goes below the vaporization threshold, the vacuum chamber is not re-pressurized, wherein the pressure level rises gradually due to leakage until the internal pressure reaches a high pressure threshold, wherein the vacuum pump turns on again to repeat the margin cycle. Since the pump will not be switched back on until the box much closer to atmospheric pressure, a great deal of energy is saved. These short bursts of the vacuum pump lowering the internal pressure of the vacuum chamber down to below a vaporization threshold achieve similar freshening results to continuously operating the vacuum pump to lower the internal pressure.

In some embodiments, the control system is configured to obtain sensor data, wherein the control system adjusts the pump rate to raise or lower the storage pressure level based on the sensor data. In some embodiments, the control system is configured to adjust the pump rate based on an enthalpy of vaporization curve for odors inside the vacuum chamber, wherein the control system provides a software module for calculating an enthalpy of vaporization curve. Many odors are volatile organic compounds that readily vaporize at room temperature. Lowering the air pressure in turn lowers the partial pressure of these volatile odors, which results in enhanced vaporization. Lowering the pressure further increases the rate of vaporization (shortening the cleaning cycle) but consumes more energy to operate the vacuum pump. Therefore, in some embodiments, the control system dynamically calculates the time required for a cleaning objective (e.g. VOC is at 5% of starting VOC air concentration) based on the current set pressure level. In some embodiments, the control system comprises a user interface allowing a user to change the time to completion of the cleaning cycle, wherein the control system adjusts the set pressure level up or down to use the minimum energy necessary to complete the cleaning cycle on time.

In some embodiments, the control system comprises a printed circuit board. In some embodiments, the control system comprises a printed circuit board located within a housing. In some embodiments, the control system is located within a housing. In some embodiments, the housing comprises a heat sink thermally coupled to the control system (e.g. heat sink is in contact with a processor of the control system). In some embodiments, the housing is a heat sink. In some embodiments, the heat sink comprises a labyrinthine passage for maximizing heat dissipation. A labyrinthine passage is a hollow pathway within the heat sink that is configured to maximize the length of the passage before exiting the heat sink. This enables maximum heat transfer from the heat sink to any gases and/or fluids passing through the labyrinthine passage. In some embodiments, air flow is directed across the control system. In some embodiments, the gases in the air are heated as they pass across the control system components (e.g. past a processor in the control system). In some embodiments, air flow is directed across the heat sink. In some embodiments, the gases in the air are heated as they pass across the heat sink. In some embodiments, air flow is directed through a labyrinthine pathway(s) in the heat sink. In some embodiments, the gases in the air are heated as they pass through the labyrinthine pathway(s) in the heat sink. In some embodiments, a liquid is directed through the labyrinthine passage, wherein the liquid is heated as it passes through the labyrinthine passage. In some embodiments, a liquid is directed through the labyrinthine passage, wherein the liquid is converted into gaseous form by heat transferred from the heat sink. In some embodiments, a liquid is directed through the labyrinthine passage at a first pressure and then exits the labyrinthine passage and enters the vacuum chamber at a second pressure, wherein the second pressure is lower than the first pressure, wherein the liquid vaporizes under the second pressure. As an example, water is passed through the labyrinthine passageway of a heat sink at 1 atm, and then exits the passageway and enters the vacuum chamber having an internal pressure of 0.1 atm. In this example, the transition to a much lower pressure enhances the vaporization of the water. In some embodiments, the liquid passing through the labyrinthine passageway becomes aerosolized upon entering the vacuum chamber having a low pressure (e.g. lower than 1 atm).

User Interface

In some embodiments, the systems, products, devices, and methods disclosed herein comprise a user interface enabling a user to enter instructions to a control system. The user interface can be analog or digital. In some embodiments, the user interface comprises a set of buttons for entering instructions. In some embodiments, the user interface comprises a screen displaying a graphic user interface ("GUI"). In some embodiments, the user interface comprises a GUI and a set of buttons. In some embodiments, the user interface communicates with the control system, wherein the control system controls the content displayed on the GUI, wherein the interface communicates to the control system any user instructions entered on the GUI. In some embodiments, the user interface comprises a screen that displays sensor data, wherein the sensor data describes at least one property of the internal space of the vacuum chamber selected from the level of pressure, volatile organic compounds, relative humidity, dew-point, small particles, and temperature. In some embodiments, the user interface comprises a screen providing information from at least one sensor disposed within the vacuum. In some embodiments, the screen provides current sensor information from ongoing sensor detection inside the vacuum chamber while the device is in operation. In some embodiments, the screen provides a graph of historical sensor data for the current odor-removing, cleaning, or disinfecting cycle.

Safety Features

In some embodiments, the systems, products, devices, and methods disclosed herein comprise one or more safety features for preventing unauthorized use. Vacuum-based technologies can pose a hazard to inexperienced individuals such as children. Therefore, in some embodiments, the vacuum-based device comprises a safety feature requiring a key to operate the device. In other embodiments, operation of the device requires entry of a password into a user interface. In yet other embodiments, operation of the device requires biometric authentication. In some embodiments, biometric authentication provides a fingerprint reader for fingerprint identification.

In some embodiments, the systems, products, devices, and methods disclosed herein comprise a pressure release valve, wherein the valve is configured to automatically open when the internal pressure of the vacuum chamber reaches a pressure threshold. Extreme pressure differences between the internal pressure of the vacuum chamber and ambient pressure can lead to structural failure of vacuum chamber and other components subject to the extreme pressure. Therefore, safeguards can be put in place to release the pressure under certain conditions. In some embodiments, the pressure release valve is configured to open when the vacuum-based device suffers a mechanical (e.g. vacuum pump malfunction) or structural failure (e.g. vacuum chamber vacuum lid cracks open).

In some embodiments, the control system is configured to detect a structural failure of the vacuum chamber, wherein the structural failure is a leak caused by a hole or crack, damage or misalignment of the gasket, or other damage to the vacuum chamber, wherein the control system detects the structural failure using sensor data showing a rapid re-pressurization. In some embodiments, the control system determines a rapid de-pressurization has occurred when the rate of change of the internal pressure exceeds a pressure change threshold. In some embodiments, the pressure change threshold is preset. In some embodiments, the pressure change threshold is entered by a user.

In some embodiments, the pressure change threshold is calculated based on the maximum pressure rate of change of the vacuum chamber when the vacuum pump is active. In some embodiments, the pressure change threshold is calculated as a multiplier of the maximum pressure rate of change of the vacuum chamber when the vacuum pump is active. In some embodiments, the multiplier of the maximum pressure rate of change is 1, 2, 3, 4, 5, 6, 7, 8, 9, 10, 15, 20, 25, 30, 35, 40, 45, 50, 60, 70, 80, 90, or 100, wherein the pressure change threshold is the maximum pressure rate of change multiplied by the multiplier. In a non-limiting example, wherein the vacuum pump achieves a maximum pressure rate of change of 50 Torr/min, wherein the multiplier is 3, the control system calculates the pressure change threshold to be 150 Torr/min, wherein any pressure change in the vacuum chamber exceeding this threshold indicates a rapid de-pressurization event.

In some embodiments, the vacuum-based device further comprises a pressure release valve configured to equilibrate the internal pressure of the vacuum chamber with ambient pressure outside the chamber. In some embodiments, the device is configured to open the pressure release valve when an alarm threshold is triggered. In some embodiments, the alarm threshold is triggered when the internal pressure is too low or too high relative to external pressure. In some embodiments, the alarm threshold is triggered when the internal pressure changes at a rate exceeding a pressure change threshold. In some embodiments, the pressure change threshold is 50 Torr/min, 100 Torr/min, 150 Torr/min, 200 Torr/min, 250 Torr/min, 300 Torr/min, 350 Torr/min, 400 Torr/min, 450 Torr/min, 500 Torr/min. 550 Torr/min, 600 Torr/min, 650 Torr/min. 700 Torr/min, 750 Torr/min, 760 Torr/min, 800 Torr/min, 900 Torr/min, Torr/min, Torr/min, Torr/min, Torr/min, Torr/min, Torr/min. Torr/min, Torr/min, Torr/min, Torr/min, or Torr/min.

Sensors in some embodiments, the systems, products, devices, and methods described herein comprise one or more sensors configured to measure at least one of pressure, volatile organic compounds, relative humidity, dew-point, small particles, and temperature of the internal space of the vacuum chamber. In some embodiments, the one or more sensors are configured to function at sub-atmospheric pressure, wherein the sub-atmospheric pressure is 0.9 atm, 0.8 atm, 0.7 atm, 0.6 atm, 0.5 atm, 0.4 atm, 0.3 atm, 0.2 atm, 0.1 atm, 0.05 atm, or 0.01 atm. In other embodiments, the one or more sensors are configured to function at above atmospheric pressure, wherein the one or more sensors is configured to function at above 2 atm, 3 atm, 4 atm, 5 atm, 6 atm, 7 atm, 8 atm, 9 atm, 10 atm, 20 atm 30 atm, 40 atm, 50 atm, 60 atm, 70 atm, 80 atm, 90 atm, or 100 atm. In yet other embodiments, the one or more sensors are configured to function at both below and above atmospheric pressure.

In some embodiments, the one or more sensors are configured to communicate with a control system, wherein the control system is configured to receive sensor data. In some embodiments, the control system controls the one or more sensors, wherein the control system can signal the one or more sensors to turn on or shut off.

Filtration System

In some embodiments, the systems, products, devices, and methods described herein comprise a filtration system configured to filter the gases pumped out of the vacuum chamber. In some embodiments, the filtration system comprises at least one filter. In some embodiments, the filtration system comprises at least one of a HEPA filter, a carbon filter, a micro filter, a dust filter. In some embodiments, at least one filter is engaged with the vacuum chamber to prevent one or more disinfection compounds from exiting the vacuum chamber. In some embodiments, at least one filter is placed at an exhaust of the vacuum chamber to filter the air or gases leaving the vacuum chamber. In some embodiments, at least one filter is placed at an intake of the vacuum chamber to filter the air or gases entering the vacuum chamber. In some embodiments, at least one filter is engaged with the vacuum chamber to prevent one or more cleaning compounds from exiting the vacuum chamber. In some embodiments, at least one filter is engaged with the vacuum chamber to prevent one or more consumables from exiting the vacuum chamber. In some embodiments, at least one filter is engaged with the vacuum chamber to prevent odor compounds from exiting the vacuum chamber. In some embodiments, at least one filter is configured to collect at least one of airborne particles, odors, disinfection compounds, and cleaning compounds. In some embodiments, at least one filter is a chemical air filter, a UV light air filter, an ionic air filter, or a particulate air filter. In some embodiments, at least one filter is a HEPA filter. In some embodiments, at least one filter is an activated carbon air filter. In some embodiments, the filtration system comprises at least 1, 2, 3, 4, 5, 6, 7, 8, 9, or 10 filters. In some embodiments, the filtration system comprises no more than 1, 2, 3, 4, 5, 6, 7, 8, 9, or 10 filters. In some embodiments, the filtration system comprises at least one filter for removing dust, pollen, mold, bacteria, odor, ozone, or VOCs from inside the vacuum chamber.

Disinfection System in some embodiments, the systems, products, devices, and methods described herein comprise a UV system. In some embodiments, the UV system is configured to disinfect at least one article disposed within the vacuum chamber. In some embodiments, the UV system generates UV light within the interior of the vacuum chamber. In some embodiments, the UV system generates germicidal UV light. In some embodiments, germicidal UV light comprises short wavelength ultraviolet light (e.g. UV-C radiation with wavelength between 100 nm to 280 nm). UV light can kill or inactivate microorganisms by damaging or destroying DNA and/or RNA. In some embodiments, the UV system comprises at least one of a cold cathode germicidal UV lamp, a hot cathode germicidal UV lamp, a slimline germicidal ultraviolet lamp, a high output germicidal UV lamp, and a UV light emitting diode (LED).

In some embodiments, the UV system is configured to irradiate the interior space of the vacuum chamber with UV radiation. In some embodiments, a cleaning cycle comprises at least one step of irradiating the interior space of the vacuum chamber with UV radiation. In some embodiments, a cleaning cycle comprises at least 1, 2, 3, 4, 5, 6, 7, 8, 9, 10, 15, 20, 25, 30, 35, 40, 45, 50, 60, 70, 80, 90, or 100 irradiation steps. In some embodiments, a cleaning cycle comprises no more than 1, 2, 3, 4, 5, 6, 7, 8, 9, 10, 15, 20, 25, 30, 35, 40, 45, 50, 60, 70, 80, 90, or 100 irradiation steps. In some embodiments, the UV system delivers at least one short burst of UV radiation during a cleaning cycle. In some embodiments, a short burst of UR radiation is at least 1, 2, 3, 4, 5, 6, 7, 8, 9, or 10 seconds. In some embodiments, a short burst of UR radiation is no more than 1, 2, 3, 4, 5, 6, 7, 8, 9, or 10 seconds. In some embodiments, the UV system delivers at least one prolonged burst of UV radiation during a cleaning cycle. In some embodiments, a prolonged burst of UV radiation is at least 5, 10, 20, 30, 40, 50, 60, 70, 80, 90, 100, 150, 200, 250, 300, 350, 400, 450, or 500 seconds. In some embodiments, a prolonged burst of UV radiation is no more than 5, 10, 20, 30, 40, 50, 60, 70, 80, 90, 100, 150, 200, 250, 300, 350, 400, 450, or 500 seconds.

Heating Subsystem

In some embodiments, the systems, products, devices, and methods described herein comprise a heating subsystem for increasing the temperature of the internal space of the vacuum chamber. Sometimes, the odor molecules, disinfecting compounds, cleaning compounds, or other undesirable chemicals on an article have a high latent heat of vaporization that resists vaporization at room temperature. Therefore, efficient vaporization of these compounds may require raising the temperature of the vacuum chamber. Thus, in some embodiments, the heating subsystem is configured to raise the temperature of the internal space of the vacuum chamber, wherein the higher temperature enhances vaporization of one or more compounds attached to an article disposed within the chamber. In some embodiments, the heating subsystem comprises at least one of a heat strip, a heat plate, a heating element, a heat pump, and a thermoelectric Peltier module. In some embodiments, the heating subsystem comprises a mechanism to radiate heat evenly throughout the vacuum chamber. In some embodiments, the mechanism for radiating heat evenly comprises at least one fan. In some embodiments, the mechanism for radiating heat comprises at least 1, 2, 3, 4, 5, 6, 7, 8, 9, or 10 fans. In some embodiments, the mechanism for radiating heating comprises no more than 1, 2, 3, 4, 5, 6, 7, 8, 9, or 10 fans.

In some embodiments, the heating subsystem comprises at least one heating element. In some embodiments, a heating element is a thermoelectric cooler that pumps heat (e.g. a heat pump). In some embodiments, a thermoelectric cooler pumps heat from a heat sink into the vacuum chamber. This allows active cooling of the circuitry (e.g. control system components associated with the heat sink) while also heating the vacuum chamber (e.g. for certain cleaning cycles requiring heat). In some embodiments, the heating subsystem comprises at least one heat pump for maintaining a specific temp. For example, a heat pump cools circuitry while heating the vacuum chamber when there is no air flow. As another example, the heat pump can be deactivated while auxiliary heat from the circuits enter the vacuum chamber. As yet another example, the polarity of the heat pump can be reversed to pump heat from the vacuum chamber to the heat sink.

Agitation System

In some embodiments, the systems, products, devices, and methods disclosed herein comprise an agitation system for agitating the contents of the vacuum chamber. In some embodiments, the agitation system provides mechanical agitation, wherein the agitation rotates or shakes the contents of the vacuum chamber.

In some embodiments, the agitation system comprises at least one fan. In some embodiments, the agitation system comprises a plurality of fans distributed throughout the vacuum chamber. In some embodiments, the agitation system comprises at least 1, 2, 3, 4, 5, 6, 7, 8, 9, or 10 fans. In some embodiments, the agitation system comprises no more than 1, 2, 3, 4, 5, 6, 7, 8, 9, or 10 fans. In some embodiments, the at least one fan agitates an article disposed within the vacuum chamber such that dirt, cleaning agents, or other particulates are blown off of the article.

in some embodiments, the agitation system comprises at least one ultrasonic transducer for providing ultrasonic agitation. In some embodiments, the agitation system comprises a plurality of ultrasonic transducers distributed throughout the vacuum chamber. In some embodiments, the agitation system comprises at least 1, 2, 3, 4, 5, 6, 7, 8, 9, or 10 ultrasonic transducers. In some embodiments, the agitation system comprises no more than 1, 2, 3, 4, 5, 6, 7, 8, 9, or 10 ultrasonic transducers. In some embodiments, the at least one ultrasonic transducer agitates an article disposed within the vacuum chamber such that dirt, cleaning agents, or other particulates are dislodged from the article. In some embodiments, the ultrasonic transducer is used in combination with a solvent or cleaning agent suitable for transmitting positive and negative pressure waves generated by the ultrasonic transducer. In some embodiments, the at least one transducer is made with piezoelectrics. In some embodiments, the at least one transducer is magnetostrictive. In some embodiments, the at least one ultrasonic transducer is used in combination with a solution containing at least one surfactant and/or detergent.

Anti-Microbial Coating in some embodiments, the systems, products, devices, and methods described herein comprise an interior surface configured to resist microbial growth. In some embodiments, the vacuum chamber comprises an interior surface configured to resist microbial growth. In some embodiments, the chamber vacuum lid comprises an interior surface configured to resist microbial growth. In some embodiments, the interior surface is configured to kill microbes. In some embodiments, the vacuum chamber and/or vacuum lid comprises an inner surface having an antimicrobial coating configured to inhibit microbial growth and/or kill microbes on the inner surface. Antimicrobial agents can include organic, inorganic, and antifungal agents. Some examples include Ag—Zn-Zeolite, Zinc oxide, 10,10'-oxybis-10H-phenoxarsine ("OBPA"), and isothiazolinone compounds. In some embodiments, the antimicrobial compound introduces zinc ions that react with bacteria to kill them and simultaneously produce more zinc ions in a chain effect. In other embodiments, the antimicrobial compound introduces silver ions having antimicrobial effect. In other embodiments, the antimicrobial compound introduces copper ions having antimicrobial properties. The biocidal effect of metals is termed the oligodynamic effect and occurs in many heavy metals, including but not limited to aluminum, antimony, arsenic, barium, bismuth, boron, copper, gold, mercury, nickel, silver, thallium, tin, and zinc. These metals are capable of reacting with thiol and/or amine groups of proteins.

Anti-Friction Coating

In some embodiments, the systems, products, devices, and methods described herein comprise an interior surface configured to reduce friction. In some embodiments, the vacuum chamber comprises an anti-friction coating. In some embodiments, the chamber vacuum lid comprises an anti-friction coating. In some embodiments, the anti-friction coating is on the surface of the interior space of the vacuum chamber and/or the surface of the chamber vacuum lid that forms the internal space. Examples of anti-friction coating materials include molybdenum disulfide, graphite, PTFE, and various synthetics. In some embodiments, the interior surface of the vacuum chamber and/or chamber vacuum lid is composed of a non-coating material having anti-friction properties. In some embodiments, materials having anti-friction properties are metallic. In other embodiments, materials having anti-friction properties are non-metallic. Examples of metallic anti-friction materials include certain tin, lead, copper, zinc, and aluminum alloys, steel, and cast, irons (e.g. gray pearlitic cast iron with specific microstructure for anti-friction properties). Examples of non-metallic anti-friction materials include certain plastics such as nylon, phenolics, Teflon/PTFE, acetal, polyimide, polysulfone, polyphenylene, and ultrahigh-molecular-weight polyethylene (UHMWPE), and carbon graphite.

Odor Removal Function

Odor-causing compounds come in a variety of forms. Many odors are associated with volatile organic compounds (VOCs) characterized as having high vapor pressure at room temperature, which is caused by a low boiling point. The low boiling point enables many molecules of a given volatile organic compound to enter the air from its liquid or so vacuum lid form via evaporation or sublimation respectively. Odor molecules or odorants that produce a scent must be sufficiently volatile to be present at vapor pressure levels that meet the threshold of detection by the olfactory system. In general, odor molecules are non-ionic organic compounds with a low molecular weight of less than 300 grams per mole. While many odor eliminators tend to use fragrances and perfumes to mask the smell of odors, their effect is limited in duration because the odor molecules are not removed. As a result, odor eliminators and air fresheners provide a temporary stopgap rather than a complete solution to unpleasant odors. Odor eliminators and air fresheners are especially poorly equipped to resolve distinctly disagreeable scents caused by odor molecules such as low molecular weight fatty acids, mercaptans, amines, indols, ammonia, and hydrogen sulfide.

There exists no technology that focuses on and effectively deals with such odors. For example, an individual might have a favorite shirt that needs to be de-odorized, but does not want to wash it after every use due to the wear-and-tear caused by water-based laundry processes. In some cases, an individual might feel embarrassed by body odor on the clothing after wearing the shirt during the day, but does not want to change shirts when going out in the evening. Washing & drying would take too long, and a waste of resources just to clean a single shirt. Odor eliminators and air fresheners only mask the odor without removing it. In some embodiments, the systems, products, devices, and methods provide a quick and convenient way to "refresh" the shirt by removing odors.

In some embodiments, the systems, products, devices, and methods disclosed herein include a vacuum-based odor-removing device comprising: a vacuum chamber comprising: a housing defining an internal space having an internal pressure; an opening; a vacuum lid adapted to engage with the opening of the vacuum chamber: and a vacuum source connected to the vacuum chamber, wherein operation of the vacuum source reduces the internal pressure of the internal space of the vacuum chamber, wherein the device is configured to remove or eliminate odors from one or more articles disposed inside the vacuum chamber.

Liquid/Gas Subsystem: Antimicrobial Function for Long-Lasting Anti-Odor Feature A significant source of body odor is bacteria. Sweat or perspiration may produce little to no odor on its own, but bacteria residing on the skin metabolize molecules secreted in the sweat to produce odor-causing compounds. For example, bacteria can metabolize proteins and amino acids to produce odorous acids such as propionic acid and isovaleric acid, which are two common sources of body odor. Proprionic acid has a vinegar-like smell and is known to be produced by Propionibacteria. Isovaleric acid is produced by *Staphyloccocus epidermis* and is partly responsible for the typical locker room odor. Furthermore, *Staphyloccocus epidermis* and *Bacillus subtilis* are both associated with a strong foot odor. *Staphyloccocus hominis* is another resident skin bacterium and is known to produce odor-associated thioalcohols. These species of bacteria are part of the normal skin flora in humans, but they can also transfer onto clothing, footwear, and other articles that come in contact with the skin and its sweat secretions. As a result, bacteria that reside on sweat-stained articles like clothing, linens, and footwear are capable of producing odor even after the article is de-odorized as they continue to break down proteins, carbohydrates, fats, and other sweat components into odor-causing compounds.

In some embodiments, the systems, products, devices, and methods herein include a vacuum-based odor-removing device comprising: a vacuum chamber comprising: a housing defining an internal space having an internal pressure; an opening; a vacuum lid adapted to engage with the opening of the vacuum chamber; a vacuum source connected to the vacuum chamber; a subsystem configured to release one or more disinfecting compounds into the vacuum chamber, wherein operation of the vacuum source reduces the internal pressure of the internal space of the vacuum chamber, wherein the reduced internal pressure enhances the rate of vaporization of odors and one or more disinfecting compounds inside the vacuum chamber, wherein the device is configured to remove or eliminate odors from one or more articles disposed inside the vacuum chamber.

Liquid/Gas Subsystem:

Antimicrobial Function for Preventing Disease Transmission Bacteria, viruses, parasites, and other disease-causing organisms can be transmitted between people not just by direct contact, but indirectly by means of commonly shared articles such as toys shared between children. Child-rearing frequently means putting children in proximity with one another for play-dates, preschool, daycare, kindergarten, grade school, and in the playground. Oftentimes, children will share toys, school supplies, personal items (e.g. phone, videogames), and other articles with one another. Some articles are difficult or are simply too time-consuming to clean and disinfect. For example LEGO blocks are small, numerous, and have crevices that are difficult to reach. LEGO blocks may be washed with water and a disinfectant compound (e.g. bleach or antibacterial soap), but washing them is a laborious process and requires a long time to dry.

Disclosed herein, in certain embodiments, are vacuum-based anti-bacterial devices configured to reduce microbial growth. In some embodiments, the systems, products, devices, and methods herein include a vacuum-based device comprising: a vacuum chamber comprising: a housing defining an internal space having an internal pressure; an opening; a vacuum lid adapted to engage with the opening of the vacuum chamber; a vacuum source connected to the vacuum chamber; a subsystem configured to release one or more disinfecting compounds into the vacuum chamber, wherein operation of the vacuum source reduces the internal pressure of the internal space of the vacuum chamber, wherein the reduced internal pressure enhances the rate of vaporization of one or more disinfecting compounds inside the vacuum chamber, wherein the device is configured to disinfect one or more articles disposed inside the vacuum chamber.

Liquid/Gas Subsystem: Stain Removal Function Chemically binding stains are the most difficult form of "dirt" to remove. Removing these stains can require the use of a solvent. In some embodiments, the systems, products, devices, and methods described herein include a vacuum-based cleaning device comprising: a vacuum chamber comprising: a housing defining an internal space having an internal pressure; an opening; a vacuum lid adapted to engage with the opening; a vacuum source engaged with the vacuum chamber, wherein the pump is configured to remove gases from the internal space of the vacuum chamber; and a subsystem configured to release at least one cleaning compound into the internal space of the vacuum chamber. In some embodiments, the cleaning compound is a solvent. In some embodiments, the at least one cleaning compound is selected from the group consisting of oxidizing solvents, reducing solvents, lacquer solvents, surfactants, acids, bases, and alcohols. In some embodiments, the cleaning compound is dissolved in a solvent. In some embodiments, the cleaning compound is dissolved in water. In some embodiments, the cleaning compound is PERC. In some embodiments, the cleaning compound is a liquid. In some embodiments, the cleaning compound has a low latent heat of evaporation. In some embodiments, the cleaning compound has a low latent heat of evaporation less than kJ/kg, less than 900 kJ/kg, less than 800 kJ/kg, less than 700 kJ/kg, less than 600 kJ/kg, less than 500 kJ/kg, less than 400 kJ/kg, less than 300 kJ/kg, less than 200 kJ/kg, less than 100 kJ/kg, less than 90 kJ/kg, less than 80 kJ/kg, less than 70 kJ/kg, less than 60 kJ/kg, less than 50 kJ/kg, less than 40 kJ/kg, less than 30 kJ/kg, less than 20 kJ/kg, or less than 10 kJ/kg.

Liquid/Gas Subsystem:

Backfilling Consumables In some embodiments, the systems, products, devices, and methods disclosed herein comprise a subsystem configured for introducing and/or injecting at least one consumable into the vacuum chamber. In some embodiments, consumables provide benefits unrelated to odor removal, disinfection, or cleaning. Instead, consumables typically provide pleasant scents or odors that invoke a psychological feeling of cleanliness (e.g. such as with fabric softeners). In some embodiments, the consumable adds a pleasant scent to the article selected from lavender, citrus, lilac, mint, cinnamon, peppermint, cloves, chamomile, rosemary, cucumber, coconut, fresh cotton, violet, vanilla, forest pine, pomegranate, pear, and sandalwood.

in some embodiments, the consumables are selected from at least one of a gas, a liquid, a sovacuum lid, or a combination thereof. In some embodiments, the consumable is selected from a substance that can give rise to a gas, a liquid, a sovacuum lid, or a combination thereof. In some embodiments, consumables or components within a consumable are configured as aerosols, wherein the subsystem is configured to introduce the one or more consumables into the vacuum chamber as aerosols using compressed gas or air, wherein the consumable or consumable component is a particle suspended in the gas or air. In some embodiments, the consumable is selected from the group consisting of scents, perfumes, air fresheners, fragrances, desiccants, conditioners, and softeners. In some embodiments, the consumable is configured to provide a scent mimicking the smell of at least one of leather, denim, silk, elastics, synthetic fabrics, and natural fibers. In some embodiments, the consumable comprises at least one oil such as, for example, an essential oil. For example, in some embodiments, the oil is ylang, jasmine, neroli, sandalwood, vanilla, lemongrass, peppermint, cedar, mandarin orange, rosehip, cottonseed, lavender, citronella, goji berry, orange, apple seed, Caribbean teakwood, frankincense, juniper, nutmeg, star anise, patchouli, rose, clove, saffron, rosemary, sage, *eucalyptus*, sweet basil, thyme, bergamot, *camellia*, chamomile, catnip, coffee, coconut, or cinnamon oil. In some embodiments, the consumable comprises an oil that is stored and dispensed inside the vacuum chamber as an aerosol. For example, in some embodiments, the oil is fed through a labyrinthine heat sink and vaporized. In some embodiments, the consumable comprises at least one enzyme. For example, in some embodiments, the enzyme is a protease, an amylase, or lipase. In some embodiments, the consumable comprises at least one wax.

in some embodiments, the vacuum pump is activated simultaneous with the backfilling of consumables into the vacuum chamber to create a direction of air flow from the point of entry of the consumables to the aperture engaged with the vacuum pump. Alternatively, the vacuum pump may be operated after the one or more backfilled consumables enter the chamber.

In some embodiments, the subsystem is configured to receive a cartridge capable of being inserted and/or removed. In some embodiments, the subsystem comprises a dock configured to safely engage a cartridge storing the at least one consumable. In some embodiments, the subsystem comprises at least one reservoir for storing one or more consumables. In some embodiments, the cartridge stores at least one consumable, at least two consumables, at least three consumables, at least four consumables, at least five consumables, at least six consumables, at least seven consumables, at least eight consumables, at least nine consumables, or at least ten consumables.

In some embodiments, the vacuum chamber further comprises at least one mechanism for dispersing the one or more consumables into the vacuum chamber. In some embodiments, the mechanism for dispersing consumables is a spray nozzle connected to the consumables subsystem. In some embodiments, the spray nozzle is configured with multiple apertures spread throughout the vacuum chamber to evenly disperse consumables into said chamber.

n other embodiments, the vacuum chamber comprises a sub-compartment configured to store one or more consumables. Certain consumables may not require a subsystem for injection into the vacuum chamber. Instead, in some embodiments, they may be stored in a simple sub-compartment inside the vacuum chamber to provide a fresh scent much like an air freshener inside a car. In some embodiments, the sub-compartment configured to store one or more consumables comprises a vent for releasing the consumable into the chamber. In some embodiments, the sub-compartment configured to store one or more consumables comprises a vent for releasing the scent of a consumable into the chamber.

Product Configurations

Portable: In some embodiments, the systems, products, devices, and methods described herein are configured to be portable. While some embodiments of the vacuum-based device are suitable for home or office use, some people might want a portable travel version for personal or business trips. The portable travel version will offer additional benefits such as ease of transportation, dual functionality for both odor removal and storage & transportation of personal effects (clothing, shoes, electronics, books, food, toiletries, etc). These functions can be accomplished by adding features found in traditional travel luggage such as extendable handlebars and wheels, straps, internal pouches and compartments for compartmentalizing personal effects/items. Therefore, in some embodiments, the systems, products, devices, and methods described herein comprise a vacuum-based odor-removing device configured to be portable comprising: a vacuum chamber comprising: a housing defining an internal space having an internal pressure; an opening; a vacuum lid adapted to engage with the opening of the vacuum chamber: a vacuum source connected to the vacuum chamber, wherein operation of the vacuum source reduces the internal pressure of the internal space of the vacuum chamber, wherein the vacuum chamber is configured to transport and store personal items.

In some embodiments, the device is configured to be portable, wherein the device further comprises wheels attached to the base of the vacuum chamber for ease of transportation. In some embodiments, the device further comprises wheels attached to the vacuum chamber and handlebars. In some embodiments, the handlebars are extendable. In some embodiments, the vacuum chamber comprises a padded internal compartment configured to store a portable electronic device. In some embodiments, the vacuum chamber of the device is configured to store personal items.

in some embodiments, the portable device is composed of lightweight materials, wherein the device weighs no more than 5 pounds, no more than 10 pounds, no more than 15 pounds, no more than 20 pounds, no more than 25 pounds, or no more than 30 pounds. In some embodiments, the portable device is composed of lightweight materials, wherein the device weighs less than 5 pounds, less than 10 pounds, less than 15 pounds, less than 20 pounds, less than 25 pounds, or less than 30 pounds. Airport travel can make it difficult to bring metallic objects, which can trigger security sensors. Therefore, in some embodiments, the portable device is configured for airport travel, wherein the device is substantially composed of non-metallic materials, wherein the device does not trigger airport security metal detectors. In some embodiments, the portable device comprises multiple detachable units, wherein one or more subsystems are configured for quick detachment, wherein the subsystems are configured to release at least one of a consumable, an odor eliminating compound, a disinfecting compound, a cleaning compound. In some embodiments, the portable device comprises subsystems configured to engage with detachable cartridges, wherein the cartridges store at least one of a consumable, an odor eliminating compound, a disinfecting compound, and a cleaning compound. This function is to allow a user to remove the cartridges and store them in check-in luggage to comply with airport security rules such as those requiring carry-on containers having liquids below a certain volume or weight (e.g. a 3.5 ounce limit).

Home use: In some embodiments, the systems, products, devices, and methods described herein are configured for home use. In some embodiments, home use configurations include safety features such as mechanisms to prevent unauthorized use. In some embodiments, home use configurations utilize light weight (e.g. plastic construction instead of stainless steel) materials to enhance portability. In some embodiments of home use configurations, the device is configured to fit within small closets designed for traditional home laundry units. In other embodiments of home use configurations, the device is configured to be no higher than 4 feet, no higher than 3 feet, no higher than 2 feet, or no higher than 1 foot. In some embodiments of home use configurations, the device comprises a vacuum chamber having an internal space of no more than 30 cubic feet, no more than 25 cubic feet, no more than 20 cubic feet, no more than 15 cubic feet, no more than 10 cubic feet, no more than 5 cubic feet, or no more than 1 cubic feet. In some embodiments, the vacuum-based device comprises one or more optional subsystems configured to release at least one of a consumable, an odor eliminating compound, a disinfecting compound, and a cleaning compound. In some embodiments, the subsystem has reinforced construction, wherein the subsystem is configured to resist catastrophic failure of a cartridge or reservoir storing a consumable or compound.

Commercial Use:

in some embodiments, the systems, products, devices, and methods described herein are configured for industrial or commercial use. In some embodiments, the commercial use configuration utilizes heavy duty materials designed to maximize durability. In some embodiments, the vacuum-based device is configured for commercial use, wherein the vacuum chamber is composed of a durable material selected from steel, stainless steel, and a metal alloy.

Space:

In some embodiments, the systems, products, devices, and methods described herein are suitable for odor removal, disinfection, and/or stain removal in space. Traditional laundry methods are unsuitable for space travel because the added weight of water and laundry machines make this option prohibitively expensive and wasteful (costing $10,000 to put one pound of payload into Earth orbit according to www.asa.ovicenters/marshallinews/background/facts/astp.tml_prt.

tm). As a result, astronauts simply jettison their soiled clothing instead of cleaning them. Storing soiled clothing prior to jettisoning them is difficult in space where storage room is at a premium, and the dirty garments can give off unpleasant odors. Therefore, in some embodiments, the systems, products, devices, and methods described herein include a vacuum-based device adapted for use in space comprising: a vacuum chamber comprising: a housing defining an internal space; an opening; a vacuum lid configured to engage with the opening; a valve configured to link the internal space to an external vacuum source; a vacuum source engaged with the valve; an adjustable vacuum regulator interposed between the valve and the vacuum source; wherein opening the regulator de-pressurizes the internal space; and a second valve configured to re-pressurize the vacuum chamber following de-pressurization.

EXAMPLES

The following illustrative examples are representative of embodiments of the systems, products, devices, and methods described herein and are not meant to be limiting in any way.

Example 1: A high school senior, John wears his favorite jacket to class. After school, John returns home and prepares to go out to a movie with friends. His jacket has absorbed his personal odors throughout the day, and John is self-conscious about the body odor emanating from his jacket. There is no time to throw the jacket in the laundry machine, and besides, it is delicate and would get ruined in the wash. Instead, he places the jacket inside the vacuum chamber of the vacuum-based odor removing device and closes the vacuum lid. John then touches the touchscreen user interface to pick a preset cleaning cycle for removing personal odors with a cleaning objective of reduction in VOCs to 5%. The vacuum-based device's control system executes the cleaning cycle instructions by activating the vacuum pump to lower the internal pressure of the vacuum chamber by pumping air out. As the pump works, the vacuum lid is pulled even tighter against the vacuum chamber with the malleable gasket helping to maintain the airtight seal. The control system monitors internal sensors that detect the VOCs released from the jacket inside the chamber. Throughout the cleaning cycle, John is able to access a visual diagram of the VOC levels to check on the current "cleanliness" of his jacket and expected time to completion of the cleaning cycle. The lower internal pressure enhances the rate of vaporization of VOCs from the jacket, and within 20 minutes, the internal sensors indicate that the VOC level inside the chamber has dropped to below 5% of the initial starting level at the beginning of the cleaning cycle. With the cleaning objective achieved, the control system activates a consumables subsystem to spray a puff of a denim scent into the vacuum chamber. Then the control system shuts down the vacuum pump and opens a pressure release valve to equilibrate the internal pressure of the vacuum chamber with ambient, atmospheric pressure. Once the vacuum chamber has been equilibrated, John is able to open the vacuum lid and retrieve his de-odorized jacket with a fresh new denim scent. The entire process has taken less than 25 minutes, and John is now ready to go out with his friends.

Example 2: Mary is a married mother of two kids. She frequently invites other parents in the neighborhood to play-dates at her home. Mary is concerned that some of these kids are sick and will leave germs on her children's toys. Her children have many toys, including a box of LEGO bricks. Cleaning these toys is not easy, so after each play-date, Mary decides to use the vacuum-based device to disinfect the toys. First, she presses her finger against a biometric fingerprint sensor to authenticate herself as a user, which signals the device to open the vacuum lid. Mary then puts a bag of LEGOs into the vacuum chamber and closes the vacuum lid. She touches the GUI interface to activate a preset disinfecting cycle using ozone, wherein a subsystem is configured to generate ozone. The control system of the device activates the subsystem to inject the ozone into the vacuum chamber. After 30 minutes, the vacuum pump turns on and removes the ozone from the vacuum chamber. Finally, the control system shuts down the vacuum pump and opens a pressure release valve to equilibrate the internal pressure of the vacuum chamber with ambient, atmospheric pressure. The vacuum lid automatically opens upon completion of the disinfecting cycle, and Mary retrieves the disinfected LEGOs.

Example 3: Bob is a partner at a commercial litigation firm. He frequently has to travel to courthouses across the country for trial. He is prone to excessive foot sweat (a form of focal hyperhidrosis), which breeds odor-causing bacteria and causes his loafers to give off particularly strong odors. Luckily, Bob has learned to deal with this problem by bringing with him a portable vacuum-based odor removing device configured for footwear. The portable device is the size of a small suitcase and shaped to accommodate a pair of shoes inside the vacuum chamber. Bob had bought the business travel variation where the portable device has dual function as a suitcase (with an extendable handlebar, straps, and wheels) along with odor removal. Every night, after coming back from the courthouse, Bob puts his shoes inside the vacuum chamber and selects the storage cycle. His shoes smelled particularly bad tonight, so Bob also selected the disinfection option. The control system of the device injected propylene glycol gas into the vacuum chamber to disinfect the soles of the shoes, where most of the odor-causing bacteria reside. After incubating with the disinfectant for 30 minutes, the control system activates the vacuum pump until internal pressure has reached a preset setting of 0.4 atmospheres. The control system maintains the sub-atmospheric pressure throughout the night by turning on the vacuum pump periodically when sensors indicate the internal pressure of the chamber had risen to 0.45 atmospheres. The continuous sub-atmospheric pressure steadily de-odorizes and dehydrates the sole of Bob's shoes. The disinfectant is also vaporized and removed under the sub-atmospheric pressure. By the next morning, Bob's shoes are dry, disinfected, and odorless. Bob selects a pine tree scent, and the control system activates the consumables subsystem to inject the appropriate scent onto his shoes. Bob then terminates the storage cycle, and the control system opens a pressure release valve to equilibrate the internal pressure. Finally. Bob retrieves his shoes, puts them on, and heads out to the courthouse.

Example 4: Jake is a volunteer on the campaign of his local state assembly representative. With the November elections coming up, he spends many hours a day going door-to-door helping constituents register to vote. This requires Jake to stand on his feet for many hours while walking very long distances and as such, he has invested in a specialized pair of comfortable insoles. Over time as his insoles take on more wear, they become less comfortable. Furthermore, they only seem to help for the first few hours of each day, and by lunchtime they become compressed and hard. Fortunately, his state assemblyman has invested in a vacuum-based shoe freshening device which he keeps in the organizing office. When Jake checks back into the office for lunch, the first, thing he does is take off his shoes and place them into the device. He logs into the device using his smartphone, and selects a cycle that has been pre-configured specifically for his shoes/insoles. He then initiates the device, and proceeds to heat his lunch while it works. The device runs an asymptotic cycle for 15 minutes while monitoring absolute humidity and the flux of particles leaving the chamber. No consumables are dispensed onto the shoes as Jake's account was not enabled to use those features of the device. When Jake grabs his shoes on his way out the door, he enjoys the reduction in smell and moisture, but most importantly sighs in relief as he feels the insoles and vamp of the shoes hug his foot snugly once more.

Example 5: In a working example of one embodiment of the vacuum-based devices described herein, the device comprises a vacuum chamber comprising a housing defining an internal space and an opening; a vacuum lid configured to engage with the opening; a vacuum pump connected to the vacuum chamber; a pressure release valve; a sensor system comprising a pressure sensor, a temperature sensor, a dust sensor, a humidity sensor, a dew point sensor, and a computer configured to receive sensor data while uploading to an internet server; and a control system comprising a computer configured to send instructions to the vacuum pump and valves. A pair of shoes was placed inside the plastic vacuum chamber, and the vacuum lid was closed. The unit was connected to a power source, allowing the on-board computer to send instructions for activating the vacuum pump. The pump was instructed to lower the internal pressure of the vacuum chamber down to 0.4 atmospheres and maintain that pressure level for 15 minutes. During this time, the sensor system measured pressure, temperature, dust, humidity, and dew point over time, with each sensor collecting a new data point every few seconds, which was pushed to an Internet server for real-time analysis on a laptop computer. At the end of the 15 minute cycle, the vacuum pump shut off, and the pressure release valve opened to equilibrate the internal pressure of the vacuum chamber with ambient atmospheric pressure. The vacuum lid was then opened, and the de-odorized shoe was retrieved.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A device comprising:

a vacuum chamber comprising:

a housing defining an internal space having an internal pressure; and an opening;

a vacuum lid configured to engage with the opening of the vacuum chamber and form a seal with the opening;

a vacuum source connected to the vacuum chamber, wherein operation of the vacuum source reduces the internal pressure of the internal space of the vacuum chamber;

a subsystem configured to introduce a consumable into the vacuum chamber before, during, or after a vacuum cycle;

a pressing mechanism, wherein the pressing mechanism is configured to remove wrinkles by pressing an article disposed within the internal space of the vacuum chamber, and a subsystem configured to introduce a gas into the vacuum chamber, wherein the gas is configured to neutralize odor, bind odor, dissolve odor, remove odor, or mask odor.

2. The device of claim 1, wherein the vacuum source is a vacuum pump.

3. The device of claim 1, wherein:

the device is configured to de-odorize at least one article disposed within the vacuum chamber; and the article is selected from the group consisting of clothing, linen, footwear, cushions, pillows, bags, purses, toys, containers, food, and foodstuffs.

4. The device of claim 1, wherein the at least one consumable is selected from the group consisting of scents, perfumes, air fresheners, fragrances, desiccants, conditioners, and softeners.

5. The device of claim 1, wherein at least one gas is stored as a compressed liquid.

6. The device of claim 1, further comprising at least one sensor disposed within the vacuum chamber, the sensor configured to function at sub-atmospheric pressure levels, wherein the at least one sensor is configured to measure at least one property selected from the group consisting of pressure, volatile organic compounds, relative humidity, dew-point, small particles, and temperature.

7. The device of claim 1, wherein the device is configured to run for at least one cleaning cycle, wherein a cleaning cycle is selected from an asymptotic cycle, a storage cycle, and a margin cycle.

8. The device of claim 1, further comprising a control system configured to execute a cleaning program comprising at least one cleaning cycle, wherein a cleaning cycle comprises:

reducing the internal pressure of the vacuum chamber to a first pressure level;

maintaining the internal pressure below a first pressure level until a cleaning cycle objective is achieved; and raising the internal pressure of the vacuum chamber to a second pressure level, wherein the second pressure level is at a higher pressure than the first pressure level.

9. The device of claim 1, further comprising a heating subsystem configured to heat the vacuum chamber, wherein the heat enhances the vaporization of odor molecules from an article disposed within the vacuum chamber.

10. A device comprising:

a vacuum chamber comprising:

a housing defining an internal space having an internal pressure; and an opening;

a vacuum lid adapted to engage with the opening and form a seal with the opening;

a vacuum source engaged with the vacuum chamber, wherein the vacuum source is configured to lower the internal pressure of the internal space of the vacuum chamber;

a pressure release valve configured to open at an end of a cleaning cycle, wherein opening the pressure release valve equilibrates an internal pressure of the vacuum chamber with external pressure;

a subsystem configured to release at least one disinfecting compound into the vacuum chamber, a subsystem configured to introduce a consumable into the vacuum chamber before, during, or after a vacuum cycle; and a subsystem configured to introduce a gas into the vacuum chamber, wherein the gas is configured to carry out at least one of the following functions: neutralizing odor, binding odor, dissolving odor, removing odor, and masking odor.

11. The device of claim 10, wherein the at least one disinfecting compound is a gas at room temperature and atmospheric pressure.

12. The device of claim 11, wherein the at least one disinfecting compound is stored as a liquid.

13. The device of claim 10, further comprising a heating subsystem engaged with the vacuum chamber, wherein the heating subsystem is configured to raise the temperature of the internal space of the vacuum chamber.

14. The device of claim 10, further comprising at least one sensor disposed within the vacuum chamber, wherein the at least one sensor is configured to measure at least one of pressure, volatile organic compounds, relative humidity, dew-point, small particles, and temperature.

15. The device of claim 10, wherein the device is configured to run for at least one disinfecting cycle, wherein a disinfecting cycle comprises:

introducing one or more disinfectant compound into the vacuum chamber;

incubating for a period of time suitable for disinfection of an article disposed within the vacuum chamber; and activating the vacuum pump to vaporize and remove the disinfectant compound from the vacuum chamber.

16. The device of claim 10, further comprising at least one air filter configured to filter the gases pumped out of the vacuum chamber by the vacuum source.

17. A method comprising:

providing a vacuum chamber having an internal space with an internal pressure;

providing an article to be disinfected, wherein the article is placed within the internal space of the chamber;

run at least one disinfecting cycle comprising:

injecting a disinfecting gas into the internal space of the vacuum chamber, the disinfecting gas having a partial pressure within the internal space and the vacuum chamber sealing the disinfecting gas within the internal space;

wherein the disinfecting gas is stored as a compressed liquid;

applying a vacuum source to the vacuum chamber, wherein the vacuum source reduces the internal pressure of the vacuum chamber to below ambient pressure outside the vacuum chamber and reduces the partial pressure of the disinfecting gas;

maintaining the sub-atmospheric internal pressure for a period of time sufficient to achieve a cleaning objective; and raising the internal pressure to atmospheric pressure.

* * * * *